US009129609B2

(12) United States Patent
Takagi et al.

(10) Patent No.: US 9,129,609 B2
(45) Date of Patent: Sep. 8, 2015

(54) SPEECH SPEED CONVERSION FACTOR DETERMINING DEVICE, SPEECH SPEED CONVERSION DEVICE, PROGRAM, AND STORAGE MEDIUM

(75) Inventors: Tohru Takagi, Tokyo (JP); Atsushi Imai, Kawasaki (JP); Nobumasa Seiyama, Tokyo (JP); Reiko Saitou, Tokyo (JP)

(73) Assignee: NIPPON HOSO KYOKAI, Tokyo (JP)

( * ) Notice: Subject to any disclaimer, the term of this patent is extended or adjusted under 35 U.S.C. 154(b) by 234 days.

(21) Appl. No.: 13/981,950

(22) PCT Filed: Jan. 27, 2012

(86) PCT No.: PCT/JP2012/000537

§ 371 (c)(1),
(2), (4) Date: Jul. 26, 2013

(87) PCT Pub. No.: WO2012/102056

PCT Pub. Date: Aug. 2, 2012

(65) Prior Publication Data

US 2013/0325456 A1 Dec. 5, 2013

(30) Foreign Application Priority Data

Jan. 28, 2011 (JP) ..... 2011-017232

(51) Int. Cl.
*G10L 19/06* (2013.01)
*G10L 21/043* (2013.01)
(Continued)

(52) U.S. Cl.
CPC ..... *G10L 21/043* (2013.01); *G10L 21/04* (2013.01); *G10L 25/78* (2013.01); *G10L 2025/783* (2013.01); *G10L 2025/906* (2013.01)

(58) Field of Classification Search
CPC ... G10L 21/04; G10L 2025/786; G10L 25/07; G10L 13/033; G10L 13/0335; G10L 19/167; G10L 19/24; G10L 2021/0135; G10L 2025/906; G10L 21/003; G10L 25/48; G10L 25/69
USPC ..... 704/233, 210, 215, 258, 267, 201, 203, 704/208, 255, 261, 278, 500, 207, 243, 211, 704/209
See application file for complete search history.

(56) References Cited

U.S. PATENT DOCUMENTS 4,692,941 A * 9/1987 Jacks et al. ..... 704/260
5,611,018 A * 3/1997 Tanaka et al. ..... 704/215
(Continued)

FOREIGN PATENT DOCUMENTS

JP A-05-257490 10/1993
JP A-06-289895 10/1994
(Continued)

OTHER PUBLICATIONS

Nejime et al., "A Portable Digital Speech-Rate Converter for Hearing Impairment", IEEE Transactions on Rehabilitation Engineering, Vo.4, No. 2, Jun. 1996, pp. 73-83.*
(Continued)

*Primary Examiner* — Vijay B Chawan
(74) *Attorney, Agent, or Firm* — Oliff PLC

(57) ABSTRACT

A speech speed conversion factor determining device has a physical index calculation unit including a sound/silence judgment unit that distinguishes between sound and silent intervals of an input signal, a fundamental frequency calculation unit that calculates a fundamental frequency of the signal in the sound intervals and determines stable and unstable intervals, a frequency smoothing unit that smoothes the fundamental frequency in the stable intervals, a pseudo fundamental frequency calculation unit that calculates, for the intervals, a pseudo fundamental frequency by interpolation , and a fundamental frequency general shape connection unit that connects the smoothed and pseudo frequencies to obtain sampled values of a general shape of the frequency, such that the sampled values are output as an index, based on which conversion factor are calculated.

9 Claims, 10 Drawing Sheets

(51) Int. Cl.

| | |
|---|---|
| ***G10L 21/04*** | (2013.01) |
| *G10L 25/78* | (2013.01) |
| *G10L 25/90* | (2013.01) |

(56) References Cited

U.S. PATENT DOCUMENTS

| | | | | |
|---|---|---|---|---|
| 5,995,925 | A | 11/1999 | Emori | |
| 6,115,684 | A * | 9/2000 | Kawahara et al. | 704/203 |
| 6,205,420 | B1 * | 3/2001 | Takagi et al. | 704/211 |
| 6,236,970 | B1 * | 5/2001 | Imai et al. | 704/278 |
| 6,374,213 | B2 * | 4/2002 | Imai et al. | 704/233 |
| 6,393,398 | B1 * | 5/2002 | Imai et al. | 704/254 |
| 2001/0010037 | A1 * | 7/2001 | Imai et al. | 704/210 |
| 2006/0224387 | A1 * | 10/2006 | Gray et al. | 704/261 |
| 2008/0027711 | A1 * | 1/2008 | Rajendran et al. | 704/201 |
| 2008/0235025 | A1 * | 9/2008 | Murase et al. | 704/260 |
| 2013/0325456 | A1 * | 12/2013 | Takagi et al. | 704/210 |

FOREIGN PATENT DOCUMENTS

| | | |
|---|---|---|
| JP | A-07-191695 | 7/1995 |
| JP | A-07-192392 | 7/1995 |
| JP | A-10-91189 | 4/1998 |
| JP | A-10-260694 | 9/1998 |
| JP | A-10-301598 | 11/1998 |
| JP | A-2011-33789 | 2/2011 |

OTHER PUBLICATIONS

Feb. 28, 2012 International Search Report issued in International Application No. PCT/JP2012/000537.

* cited by examiner $$x'(k)=h(k)\cdot x(k)$$

$$R(\tau)=\frac{1}{K-\tau}\sum_{k=0}^{K-1-\tau}x'(k)\cdot x'(k+\tau)$$

SPEECH SPEED CONVERSION FACTOR DETERMINING DEVICE, SPEECH SPEED CONVERSION DEVICE, PROGRAM, AND STORAGE MEDIUM

CROSS-REFERENCE TO RELATED APPLICATION

This application is based on an application No. 2011-017232 filed in Japan on Jan. 28, 2011, the entire contents of which are hereby incorporated by reference.

FIELD

The present invention relates to a speech speed conversion factor determining device, a speech speed conversion device, a program, and a storage medium for determining an adaptive conversion factors for speech speed (the rate of speaking) of an input signal.

BACKGROUND

With a technology for adaptive speech speed conversion, for a given playback speed, such as 1× speed (playback in real time) or 2× speed (playback in half of real time), the speed is not changed by a uniform factor α over the entire input signal, but rather the speed is changed in each section by a factor larger or smaller than the factor α so as to balance the overall playback time to be the same as when speech speed is converted at the uniform factor α. Thereby it is aimed to generate speech speed converted voice that is "slower and easier to hear" for the listener than when speech speed is converted at the uniform factor α.

Some techniques for achieving the above include (1) lowering the speech speed where the fundamental frequency is high and raising the speech speed where the fundamental frequency is low, (2) treating an interval spoken in one breath as a unit, lowering the speech speed at the start of the interval, and gradually raising the speech speed towards the end of the interval in accordance with changes in the fundamental frequency, and (3) shortening a silent interval between intervals spoken in one breath to a degree that preserves a natural sound (for example, see Patent Literature 1).

Another technique treats a silent interval of at least a given length as a pause, and in a voice interval located between pauses, lowers the speech speed at the start of the voice interval, progressively raises the speech speed during a given time T based on a predetermined decreasing function, and after the given time T elapses, changes the factor for lowering the speech speed by taking into consideration the relative magnitude of the maximum fundamental frequency in each voice interval (for example, see Patent Literature 2).

Within the speech speed control disclosed in Patent Literature 1 or Patent Literature 2, another known technique allows for a brief silent interval within a voice interval located between pauses to be shortened to a degree that still preserves a natural sound. This technique also lowers the subsequent speech speed in so far as possible when the speech speed of each section matches, or is only slightly later than, the time assumed when the speech speed being converted at a uniform factor α, and reduces the amount by which the subsequent speech speed is lowered as the speech speed of each section is increasingly later than the time assumed when the speech speed is converted at the uniform factor α. This technique thereby lessens misalignment, in so far as possible, with the time assumed when the speech speed of each section of the speech speed converted voice is converted at the uniform factor α (for example, see Patent Literature 3).

Furthermore, when separating the input signal into voice intervals and silent intervals, lowering the speech speed in the voice intervals, and shortening the silent intervals, the output voice length extends beyond the input signal length per unit time due to the lowering of the speech speed in the voice intervals. It thus becomes necessary to store the voice after speech speed conversion temporarily in memory, yet there is a limit on memory capacity. Therefore, a technique is known for gradually raising the speech speed in the voice intervals and increasing the amount cut from the silent intervals in accordance with the remaining memory capacity (for example, see Patent Literature 4 and 5).

Additionally, a technique is known for determining the speech speed of each section using a coefficient such that the speech speed is inversely proportional to the increase or decrease of the magnitude (power) or pitch (fundamental frequency) of the input signal, or a coefficient such that the speech speed is inversely proportional to the $n^{th}$ power of the value of the magnitude or volume of the input signal (for example, see Patent Literature 6).

CITATION LIST

Patent Literature

1: JP3249567B2
2: JP3219892B2
3: JP3220043B2
4: JP3357742B2
5: JP3373933B2
6: JP3619946B2

Features common to the techniques disclosed in Patent Literature 1 through 5 are dividing an input signal into voice intervals with voice and silent intervals without voice, extending or contracting the duration section by section in the voice intervals based on some sort of information, shortening the silent intervals, and comprehensively adjusting the overall voice time length. These methods present no problem when the input signal only contains a human voice, but when background sound and voice are intermingled, as in a broadcast program or the like, there is no guarantee as to whether an interval containing only background sound and no voice will be judged to be a "silent interval" or a "voice interval". Proper operation cannot be expected when judgment is erroneous, and the speech speed converted voice might be hard to listen to.

With regard to Patent Literature 6, the magnitude (power) of the input voice can be calculated for all intervals of the input voice, but the pitch (fundamental frequency) of the input voice can only be correctly calculated in an interval that includes voice and is a "voiced interval" in which the vocal cords are vibrating. Accordingly, Patent Literature 6 is problematic as well when background sound and voice are intermingled. In an interval with only background sound and no voice, the power is large, and the fundamental frequency cannot be properly calculated. Therefore, even though the speech speed actually needs to be raised in such an interval without voice, the speech speed may end up being lowered since the power is large.

When background sound and voice are intermingled, speech speed conversion methods thus have the problem of not performing adaptive speech speed conversion as expected if voice intervals with voice and silent intervals without voice are not properly distinguished.

In order to resolve the above problem, the present invention is to provide a speech speed conversion factor determining device, a speech speed conversion device, a program, and a storage medium that can stably determine adaptive speech speed conversion factors even when background sound and voice are intermingled.

SUMMARY

In order to resolve the above problem, a speech speed conversion factor determining device according to the present invention is for determining adaptive conversion factors for speech speed of an input signal and includes: a physical index calculation unit including: a sound/silence judgment unit configured to distinguish between sound intervals and silent intervals of the input signal; a fundamental frequency calculation unit configured to calculate a fundamental frequency of the input signal in the sound interval at given time intervals and to determine stable interval in which change in values of the fundamental frequency is within a predetermined variation range and unstable intervals in which change in the values of the fundamental frequency exceeds the predetermined variation range; a frequency smoothing unit configured to smooth a time variation of the fundamental frequency in the stable interval; a pseudo fundamental frequency calculation unit configured to calculate, for the unstable interval and the silent interval, a pseudo fundamental frequency by interpolating a fundamental frequency with reference to values of the smoothed fundamental frequency in the stable interval; and a fundamental frequency general shape connection unit configured to connect the smoothed fundamental frequency and the pseudo fundamental frequency to obtain sampled values of a general shape of a continuous fundamental frequency; the physical index calculation unit being configured to output the sampled values of the general shape of the fundamental frequency as a physical index; and a speech speed conversion factor designation unit configured to calculate speech speed conversion factors to be designated for the input signal based on the physical index.

In the speech speed conversion factor determining device according to the present invention, the physical index calculation unit may include a power calculation unit configured to calculate a power of the input signal at given time intervals and a power smoothing unit configured to smooth a time variation of the power to obtain sampled values of a general shape of the power, and the physical index calculation unit may output the sampled values of the general shape of the fundamental frequency and the sampled values of the general shape of the power as the physical index.

In the speech speed conversion factor determining device according to the present invention, the physical index calculation unit may include a voicing degree calculation unit configured to calculate voicing degrees from an input signal waveform and a voicing degree smoothing unit configured to smooth a time variation of the voicing degrees to obtain sampled values of a general shape of the voicing degrees, and the physical index calculation unit may output the sampled values of the general shape of the fundamental frequency, the sampled values of the general shape of the power, and the sampled values of the general shape of the voicing degrees as the physical index.

In the speech speed conversion factor determining device according to the present invention, the physical index calculation unit may include a fundamental frequency unevenness degree calculation unit configured to calculate unevenness degrees representing a trend of change in the general shape of the fundamental frequency, and the physical index calculation unit may output the sampled values of the general shape of the fundamental frequency, the sampled values of the general shape of the power, and the unevenness degrees of the general shape of the fundamental frequency as the physical index.

In the speech speed conversion factor determining device according to the present invention, the physical index calculation unit may include a power unevenness degree calculation unit configured to calculate unevenness degrees representing a trend of change in the general shape of the power, and the physical index calculation unit may output the sampled value of the general shape of the fundamental frequency, the sampled value of the general shape of the power, and the unevenness degrees of the general shape of the power as the physical index.

In the speech speed conversion factor determining device according to the present invention, the physical index calculation unit may include a frequency band splitting/power calculation unit configured to calculate a power spectrum of the input signal, a normalized power in a first frequency band, and a normalized power in a second frequency band higher than the first frequency band, and a split band power ratio calculation unit configured to calculate ratios between the normalized powers of the first frequency band and the second frequency band, and the physical index calculation unit may output the sampled values of the general shape of the fundamental frequency, the sampled values of the general shape of the power, and the ratios between the normalized powers of the first frequency band and the second frequency band as the physical index.

In the speech speed conversion factor determining device according to the present invention, the speech speed conversion factor designation unit may calculate the speech speed conversion factors based on the physical index and on a rate of contribution to the speech speed by each physical index.

The speech speed conversion factor determining device according to the present invention may further include a speech speed conversion factor fine adjustment unit configured to determine final speech speed conversion factors by, upon provision of a required playback time length of an entirety of the input signal or of divided portions of the input signal, finely adjusting the speech speed conversion factors so that a time length of the entirety of the input signal or of divided portions of the input signal matches the required playback time length.

In order to resolve the above problem, a speech speed conversion device according to the present invention is for performing adaptive speech speed conversion on an input signal and includes: the above-described speech speed conversion factor determining device and a speech speed conversion unit configured to perform speech speed conversion on the input signal in accordance with the speech speed conversion factors, such that the speech speed conversion unit, upon provision of a required playback time length of an entirety of the input signal or of divided portions of the input signal, calculates an amount of temporal misalignment by comparing on a signal time series, at given time intervals, a target signal to be output when expanding or contracting the input signal by a uniform factor with a converted signal yielded by converting the input signal at the speech speed conversion factors, and the speech speed conversion factor fine adjustment unit readjusts subsequent speech speed conversion factors in accordance with the amount of temporal misalignment.

In order to resolve the above problem, a program according to the present invention is for causing a computer, configured as a speech speed conversion factor determining device for determining adaptive conversion factors for speech speed of an input signal, to perform the steps of: distinguishing between sound intervals and silent intervals of the input signal; calculating a fundamental frequency of the input signal in the sound interval at given time intervals and determining stable intervals in which change in values of the fundamental frequency is within a predetermined variation range and unstable intervals in which change in the values of the fundamental frequency exceeds the predetermined variation range; smoothing time variations of the fundamental frequency in the stable intervals; calculating, for the unstable intervals and the silent intervals, a pseudo fundamental frequency by interpolating a frequency with reference to values of the smoothed fundamental frequency in the stable intervals; connecting the smoothed fundamental frequency and the pseudo fundamental frequency to obtain sampled values of a general shape of a continuous fundamental frequency; and calculating speech speed conversion factors to be designated for the input signal in accordance with the sampled values of the general shape of the fundamental frequency. A storage medium according to the present invention has this program stored thereon.

According to the adaptive speech speed conversion based on physical features such as the fundamental frequency and power of an input signal, as discussed herein, it is possible to avoid the problem of adaptive speech speed conversion not being performed as expected if background sound and voice are intermingled and a "voice interval" cannot be properly distinguished from a "silent interval". Stable adaptive speech speed conversion is thus allowed for, which sounds natural and effectively achieves an unhurried quality even when background sound and voice are intermingled.

BRIEF DESCRIPTION OF DRAWINGS

The present invention will be further described below with reference to the accompanying drawings, wherein.

DESCRIPTION OF EMBODIMENTS

The following describes embodiments of the present invention in detail with reference to the drawings.

Embodiment 1

Figure 1:
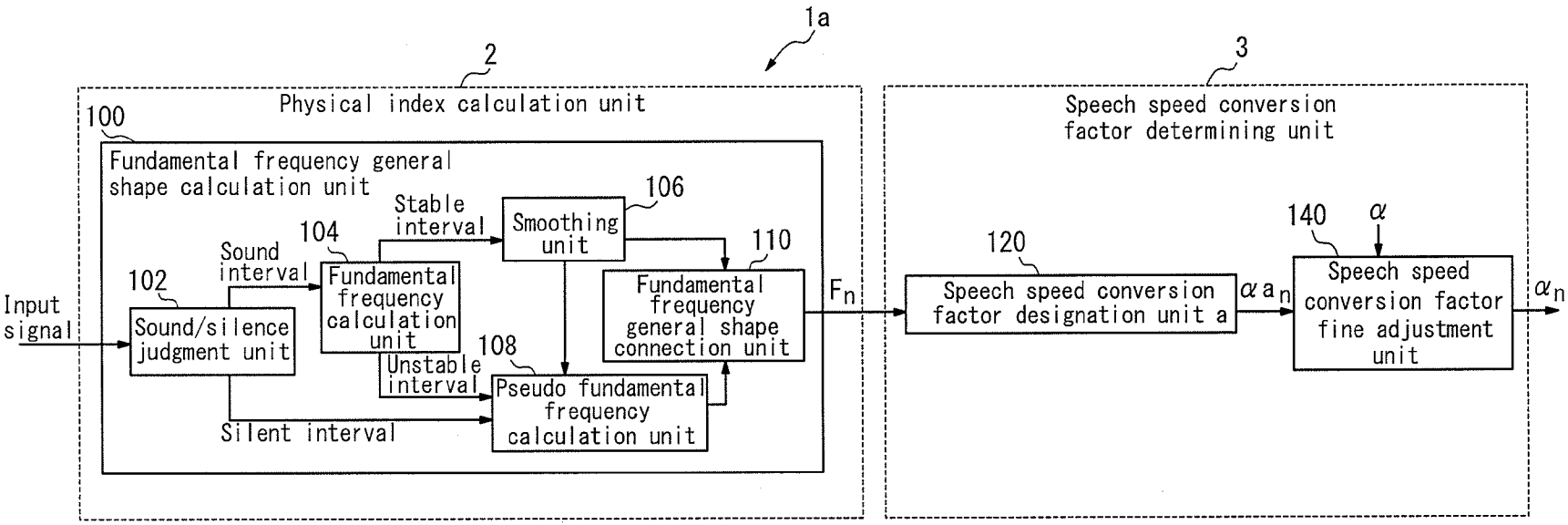
FIG. 1 is a block diagram illustrating the configuration of a speech speed conversion factor determining device according to Embodiment 1 of the present invention.

FIG. 1 is a block diagram illustrating the configuration of a speech speed conversion factor determining device according to Embodiment 1 of the present invention. A speech speed conversion factor determining device 1*a* of the present embodiment is provided with a physical index calculation unit 2 and a speech speed conversion factor determining unit 3, and thereby performs adaptive speech speed conversion of an input signal. The physical index calculation unit 2 calculates a physical index of an input signal. Based on the physical index input from the physical index calculation unit 2, the speech speed conversion factor determining unit 3 determines a speech speed conversion factor $\alpha_n$ that is to be designated for each segment (interval) of the input signal. The suffix n as used herein is an integer indicating the ordinal position when the input signal is divided from the start in units of time (given time intervals, such as 5 ms). Hereinafter, an interval of 5 ms is described as an example of division into segments per unit time.

The physical index calculation unit 2 is provided with a fundamental frequency general shape calculation unit 100 that includes a sound/silence judgment unit 102, a fundamental frequency calculation unit 104, a smoothing unit 106, a pseudo fundamental frequency calculation unit 108, and a fundamental frequency general shape connection unit 110. The speech speed conversion factor determining unit 3 is provided with a first speech speed conversion factor designation unit (speech speed conversion factor designation unit a) 120 and a speech speed conversion factor fine adjustment unit 140.

The speech speed conversion factor determining device 1*a* of the present embodiment comprehensively uses $F_n$, as a "physical index" to determine the speech speed conversion factor $\alpha_n$ to be designated for each segment of the input signal. $F_n$ represents the general shape of change in the fundamental frequency and the pseudo fundamental frequency of the input signal for each unit time (5 ms).

Below, the determination of the speech speed conversion factor for each interval of the input signal based on the physical index $F_n$ is described in order. The speech speed conversion factor as used herein refers to the conversion factor for the playback speed of the input signal and corresponds to the inverse of the temporal expansion/contraction ratio for the signal interval per unit time.

Calculation of Physical Index $F_n$

Figures 2A, 2B, 2C:
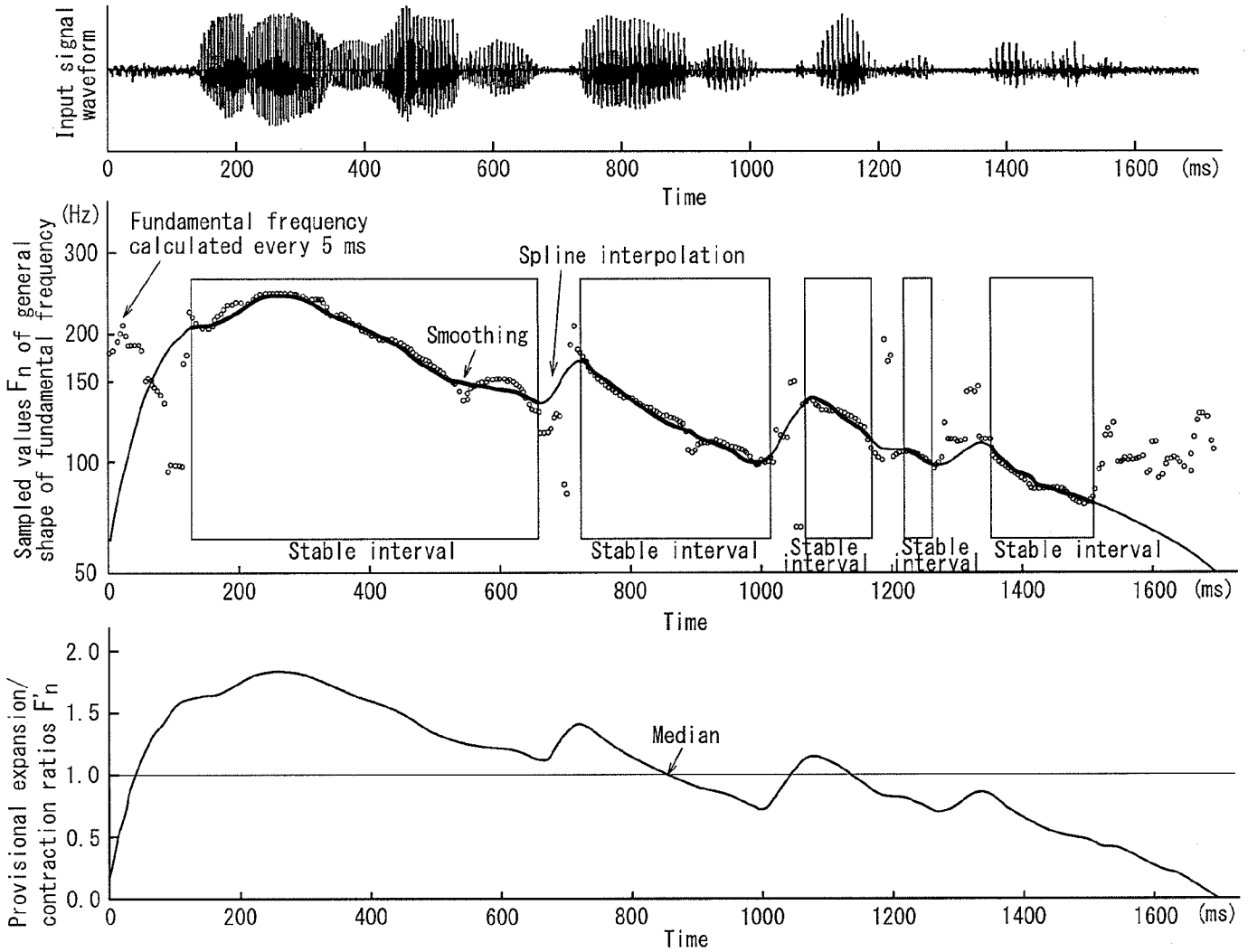
FIGS. 2A, 2B and 2C illustrate an example of calculating the general shape of the fundamental frequency and of determining a provisional expansion/contraction ratio.

First, the calculation of the physical index is described with reference to FIGS. 1 and 2. FIGS. 2A, 2B and 2C illustrate an example of calculating the general shape of the fundamental frequency and of determining provisional expansion/contraction ratios.

The sound/silence judgment unit 102 calculates the input signal amplitude and power based on the input signal, and in accordance with the magnitudes thereof, judges whether the input signal is a "sound interval" or a "silent interval". The former contains "voice", "background sound" (music or noise), or both simultaneously, whereas the latter contains no sound. For example, an interval is determined to be a sound interval when the amplitude or power of the input signal exceeds a predetermined threshold and to be a silent interval when the amplitude or power is less than a predetermined threshold.

The following describes a simple example of using the power threshold. When an input signal x(k) is extracted by aligning the center of the $n^{th}$ segment with the center of a hamming window h(k) corresponding to a window width of 20 ms, the number of sample points is K, and the quantization accuracy of the input signal is 16 bits, then the power of the segment is defined by Equation (1).

Math 1

$$P_n = 10 \cdot \log_{10}\left[\left\{\sum_{k=0}^{K-1}(h(k)\cdot x(k))^2 / K\right\} \Big/ (32768)^2\right](\text{dB}) \quad (1)$$

The sound/silence judgment unit 102 outputs the signal for a sound interval to the fundamental frequency calculation unit 104 and the signal for a silent interval to the pseudo fundamental frequency calculation unit 108. FIG. 2A illustrates an example of an input signal waveform judged by the sound/silence judgment unit 102 to be a sound interval.

The fundamental frequency calculation unit 104 calculates the fundamental frequency for each unit time (given time interval, such as 5 ms) for the input signal judged to be a sound interval and input from the sound/silence judgment unit 102, determines that an interval in which the calculated fundamental frequency is stable within a predetermined variation range and changes almost continually is a "stable interval", and determines that an interval in which the calculated fundamental frequency is not stable and changes in an abrupt and discontinuous manner is an "unstable interval". The fundamental frequency calculation unit 104 also identifies the fundamental frequency values in each stable interval, outputs the identified fundamental frequency values in each stable interval to the smoothing unit 106, and outputs the signal for the unstable intervals to the pseudo fundamental frequency calculation unit 108. The fundamental frequency calculation unit 104 discards each fundamental frequency value for an "unstable interval". Note that the fundamental frequency per unit time may be calculated using any technique (for example, see JP3219868B2). FIG. 2B shows a plot of the fundamental frequency per unit time for the input signal illustrated in FIG. 2A. FIG. 2B also shows each "stable interval" surrounded by a rectangular frame, with every other interval being an "unstable interval".

So that the fundamental frequency values of each stable interval input from the fundamental frequency calculation unit 104 form a smoother trajectory, the smoothing unit 106 smoothes the trajectory composed of the fundamental frequency values of each stable interval. For this smoothing, a low pass filter with a cutoff frequency of approximately 3 to 6 Hz is suitable. The smoothing unit 106 then outputs the fundamental frequency values of the stable intervals with a smoothed trajectory to the pseudo fundamental frequency calculation unit 108 and the fundamental frequency general shape connection unit 110. FIG. 2B shows each smoothed fundamental frequency trajectory with a bold line.

The pseudo fundamental frequency calculation unit 108 uses each of fundamental frequency values of the stable intervals with a smoothed trajectory provided by the smoothing unit 106 to calculate pseudo fundamental frequency values for each silent interval and unstable interval by interpolation using an interpolation function (for example, a spline function), outputting the calculated pseudo fundamental frequency values to the fundamental frequency general shape connection unit 110. FIG. 2B shows the fundamental frequency of a pseudo fundamental frequency with a thin line.

The fundamental frequency general shape connection unit 110 connects the fundamental frequency values of the stable intervals with a smoothed trajectory provided by the smoothing unit 106 with the pseudo fundamental frequency values of the silent intervals and the unstable intervals provided by the pseudo fundamental frequency calculation unit 108, calculates a continuous trajectory, composed of the fundamental frequency and the pseudo fundamental frequency, across all intervals (for each unit time) of the input signal targeted for processing, and outputs values $F_n$ sampled at each unit time from the general shape of the fundamental frequency (hereinafter referred to as "sampled values of the general shape of the fundamental frequency") to the first speech speed conversion factor designation unit (speech speed conversion factor designation unit a) 120 of the speech speed conversion factor determining unit 3.

Determination of Speech Speed Conversion Factor

Next, the determination of the speech speed conversion factor is described with reference to FIGS. 1 and 2A-2C. Basically, the first speech speed conversion factor designation unit (speech speed conversion factor designation unit a) 120 makes the speech speed conversion factor per unit time (hereinafter simply referred to as "speech speed conversion factors") $\alpha a_n$ relatively smaller (slower speech speed) in a portion where the sampled values $F_n$ of the general shape of the fundamental frequency is large and makes the speech speed conversion factors $\alpha a_n$ relatively larger (faster speech speed) in a portion where the sampled values $F_n$ of the general shape of the fundamental frequency is small. In other words, the first speech speed conversion factor designation unit (speech speed conversion factor designation unit a) 120 makes the speech speed conversion factors $\alpha a_n$ relatively small in a portion where the voice (fundamental frequency) is high pitched and relatively large in a portion where the voice is low pitched. This is because in a portion where the voice is high pitched, meaning is being stressed, and that portion of the sentence may be important. It is considered that making the speech speed relatively slow facilitates understanding of the words at the converted speech speed.

Furthermore, as described above, the probability that the silent interval and the unstable interval do not represent voice is high, and therefore it is considered that a relatively fast speech speed will have little adverse effect upon understanding. In the pseudo fundamental frequency calculation unit 108, the pseudo fundamental frequency of an interval is calculated by spline interpolation or the like using the fundamental frequency of the preceding and subsequent stable intervals. Physical characteristics of the speech of an average person are such that in a portion as speech begins from time 150 ms in FIG. 2B, the change in fundamental frequency has an upward slope, and immediately before a pause, i.e. near time 1500 ms in FIG. 2B, the change in fundamental frequency has a downward slope. Accordingly, while not shown in FIG. 2B, the pseudo fundamental frequency of a certain pause interval (including an interval with only background sound) is often interpolated as a valley protruding downwards. In other words, the sampled values $F_n$ of the general shape of the fundamental frequency become relatively small in that portion, resulting in an increase in the speech speed conversion factors $\alpha a_n$ and causing the speech speed to become more rapid.

Next, a few examples of a method for determining speech speed factors using the sampled values $F_n$ of the general shape of the fundamental frequency are described. When the number of sampled values $F_n$ of the general shape of the fundamental frequency is limited, the first speech speed conversion factor designation unit (speech speed conversion factor designation unit a) 120 uses the median to normalize all of the sampled values. For example, the first speech speed conversion factor designation unit (speech speed conversion factor designation unit a) 120 considers the median to be 1.0, and when the difference is larger between the maximum value and the median than between the minimum value and the median, considers the maximum value to be 2.0, allocates a new value between 0 and 2 to all of the sampled values $F_n$ of the general shape of the fundamental frequency by proportional distribution, and assigns the new value to be a provisional expansion/contraction ratio $F'_n$ for each unit time (5 ms). When the difference is larger between the minimum value and the median than between the maximum value and the median, the first speech speed conversion factor designation unit (speech speed conversion factor designation unit a) 120 considers the minimum value to be 0.0 and performs similar operations. Similar operations may also be performed after calculating log $F_n$ for all sampled values $F_n$ of the general shape of the fundamental frequency. Furthermore, instead of the median, the average of all of the sampled values $F_n$ of the general shape of the fundamental frequency or the average of the maximum value and the minimum value may be used. FIG. 2C shows the provisional expansion/contraction ratios $F'_n$ for the sampled values $F_n$ of the general shape of the fundamental frequency shown in FIG. 2B. In this example, since the frequency (vertical axis) is a logarithmic scale, $F'_n$ is calculated based on the general shape of the fundamental frequency given by log $F_n$.

When the speech speed conversion factor determining device 1*a* needs to operate in real time and perform speech speed conversion sequentially for an input signal, the number of sampled values $F_n$ of the general shape of the fundamental frequency is not determined. Therefore, the first speech speed conversion factor designation unit (speech speed conversion factor designation unit a) 120 may store the sampled values $F_n$ of the general shape of the fundamental frequency for the past three seconds, for example, and use the maximum value, the minimum value, the median, or the like to normalize the current sampled values $F_n$ of the general shape of the fundamental frequency and assign this value as the provisional expansion/contraction ratio $F'_n$. However, in this case, the smoothing unit 106 in the physical index calculation unit 2 only uses the calculation results for the past and present fundamental frequency to perform the smoothing computation. The pseudo fundamental frequency calculation unit 108 also calculates interpolated values with a spline function or the like using the past output of the smoothing unit 106. However, as described above, as speech ends, the change in fundamental frequency has a negative slope, and therefore if only the past output of the smoothing unit 106 is used to interpolate the subsequent pseudo fundamental frequency, the values rapidly decrease. This issue is handled by, for example, placing a lower limit on the fundamental frequency (such as ½ the average of the sampled values $F_n$ of the general shape of the fundamental frequency for the past three seconds).

Next, calculation of the speech speed conversion factors $\alpha a_n$ corresponding to the values of the provisional expansion/contraction ratios $F'_n$ is explained. As described above, the values of the provisional expansion/contraction ratio $F'_n$ are normalized between 0 and 2, and therefore the first speech speed conversion factor designation unit (speech speed conversion factor designation unit a) 120 calculates the speech speed conversion factors $\alpha a_n$ using, for example, equations (2) and (3) below.

Math 2

$$\alpha a_n = F'^{-1}_n \quad (2)$$

$$\alpha a_n = K^{(1.0-F'n)} \quad (3)$$

Here, along with the provisional expansion/contraction ratio $F'_n$, K is a constant for adjusting the range for lowering and raising the speech speed. For example, K is from 1.4 to 2.0.

Finally, operations by the speech speed conversion factor fine adjustment unit 140 are described. The $n^{th}$ speech speed $\alpha_n$ counting from the start of the input signal by unit time (5 ms) is calculated by equations (2) and (3).

When speech speed conversion factors $\alpha$ ($\alpha$x speed) (hereinafter referred to as "playback rate conversion factors") for the entire input signal are provided, these factors are finely adjusted by the following steps. Any values, for example from 0.5 to 5.0, can be set as the playback rate conversion factors a. In the case that the playback rate conversion factor $\alpha$ is provided, then the length of the entire signal after conversion will be $L/\alpha$, where the length of the entire input signal is L (in units of seconds). Therefore, the speech speed conversion factor fine adjustment unit 140 first converts the speech speed of all input signal intervals and calculates the length $L_0$ of the entire converted voice after connection.

Next, using equation (4) below, the speech speed conversion factor fine adjustment unit 140 finely adjusts the speech speed conversion factors $\alpha a_n$ to determine the final speech speed conversion factors $\alpha_n$ and can thereby align the length of the entire converted signal with a required playback time length.

$$\alpha a_n = \alpha a_n \times L_0/(L/\alpha) \quad (4)$$

If as frequently as possible the length is made to correspond to the same timing as when voice is converted uniformly at the playback rate conversion factor $\alpha$, then the speech speed conversion factor fine adjustment unit 140 modifies the speech speed conversion factor $\alpha_n$ by performing fine adjustment not with respect to the length L of the entire input signal, but rather the length of voice divided into shorter units. For example, when L is divisible into M intervals, i.e. $L=L_1+L_2+L_M$, the speech speed conversion factor fine adjustment unit 140 divides the input waveform into intervals $L_1, L_2, \ldots, L_M$, and in each divided interval, for the $m^{th}$ interval, first converts the speech speed of the $m^{th}$ interval using the speech speed conversion factor $\alpha a_n$ for that interval and calculates the partial length $Lm_0$ of the converted voice after connection. The speech speed conversion factor fine adjustment unit 140 then calculates each speech speed conversion factor $\alpha_n$ by substituting Lm for L and $Lm_0$ for $L_0$ into equation (4) and performs speech speed conversion again in order to perform fine adjustment.

Note that a variety of methods have already been proposed as a speech speed conversion (waveform expansion/contraction) method for implementing the speech speed conversion factors $\alpha_n$. Methods that preserve the pitch of the voice include the PICOLA (Pointer Interval Controlled OverLap and Add) method, the TDHS (Time Domain Harmonic Scaling) method, and the PSOLA (Pitch Synchronous OverLap Add) method. Other waveform expansion/contraction methods are also disclosed in JP2612868B2, JP3083830B2, JP2955247B2 and the like. Any of these waveform expansion/contraction methods may be used.

Figure 3:
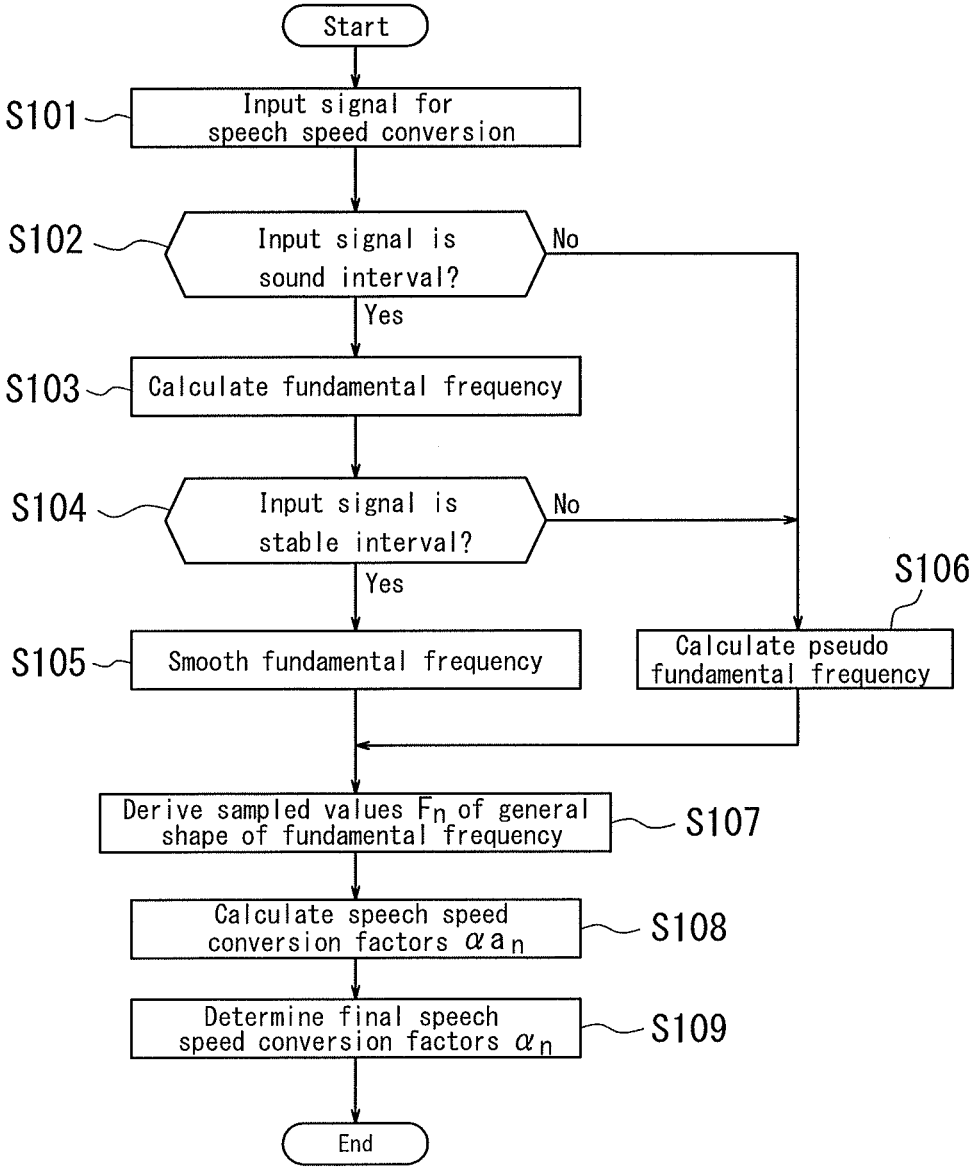
FIG. 3 is a flowchart illustrating operations of the speech speed conversion factor determining device according to Embodiment 1 of the present invention.

FIG. 3 is a flowchart illustrating operations of the speech speed conversion factor determining device 1*a* in Embodiment 1. A signal for speech speed conversion is input into the speech speed conversion factor determining device 1*a* (step S101). Upon input of a signal for speech speed conversion, the speech speed conversion factor determining device 1*a*, by using the sound/silence judgment unit 102, distinguishes between a sound interval and a silent interval in the input signal (step S102). When a sound interval is distinguished in step S102, the speech speed conversion factor determining device 1*a*, by using the fundamental frequency calculation unit 104, calculates the fundamental frequency per unit time (step S103) and, based on the degree of change in the fundamental frequency, distinguishes between a stable interval and an unstable interval (step S104). When a stable interval is distinguished in step S104, the speech speed conversion factor determining device 1*a*, by using the smoothing unit 106, smoothes the trajectory composed of the fundamental frequency of each stable interval (step S105).

On the other hand, when a silent interval is distinguished in step S102, or when an unstable interval is distinguished in step S104, the speech speed conversion factor determining device 1*a*, by using the pseudo fundamental frequency calculation unit 108, calculates the pseudo fundamental frequency in the silent interval or the unstable interval by interpolation with an interpolation function using the fundamental frequency values of the smoothed trajectory for the stable intervals (step S106). In general, in a portion with only background sound such as noise or music, the fundamental frequency cannot be stably calculated, and therefore this pseudo fundamental frequency is calculated. Furthermore, if a portion of the input signal contains no noise or background sound, no fundamental frequency is calculated for the "silent interval" detected in that portion. Instead, the pseudo fundamental frequency is calculated by interpolation with reference to the values of intervals for which the fundamental frequency was stably calculated.

The speech speed conversion factor determining device 1*a* then uses the fundamental frequency general shape connection unit 110 to connect the fundamental frequency values of the trajectory of the stable intervals smoothed in step S105 with the pseudo fundamental frequency values of the silent intervals and unstable intervals calculated in step S106 to derive sampled values $F_n$ of the general shape of the fundamental frequency (step S107). Next, the speech speed conversion factor determining device 1*a* uses the first speech speed conversion factor designation unit (speech speed conversion factor designation unit a) 120 to calculate the speech speed conversion factors $\alpha a_n$ based on the sampled values $F_n$ of the general shape of the fundamental frequency (step S108). In a portion where the sampled values $F_n$ of the general shape of the fundamental frequency are large, the speech speed is lowered to corresponding degrees, and in a portion where the values are small, the speech speed is raised to corresponding degrees. In this way, even when noise and background sound are intermingled in the input signal, adaptive speech speed conversion can be performed stably while aligning the time length with the total target time length. Finally, the speech speed conversion factor determining device 1*a* uses the speech speed conversion factor fine adjustment unit 140 to determine the final speech speed conversion factors $\alpha_n$ upon provision of playback rate conversion factors a (step S109).

Accordingly, the speech speed conversion factor determining device 1*a* of the present embodiment can perform adaptive speech speed conversion even when background sound and voice are intermingled. Furthermore, by including the speech speed conversion factor fine adjustment unit 140, in the case that an arbitrary playback rate conversion factor $\alpha$ is provided, such as 1× speed (playback at the original time length) or 2× speed (playback in half of real time), then when changing the speed in each portion at a factor that is larger or smaller than the playback rate conversion factor $\alpha$, the speech speed is finely adjusted sequentially so as to balance the overall playback time to be the same as when the speech speed is converted uniformly at the playback rate conversion factor $\alpha$. As a result, speech speed converted voice can be generated to have the same time length as when speech speed is converted uniformly at the playback rate conversion factor $\alpha$. When a predetermined time length is set for each of N portions divided based on a predetermined rule, then the speech speed is finely adjusted sequentially so as to balance the playback time to be the same as when playing back speech speed converted uniformly at playback rate conversion factors $\alpha_1, \alpha_2, \alpha_3, \ldots, \alpha_N$ that are for conformation to the time lengths provided to the divided portions $W_1, W_2, W_3, \ldots, W_N$.

Speech Speed Conversion Device

Figure 4:
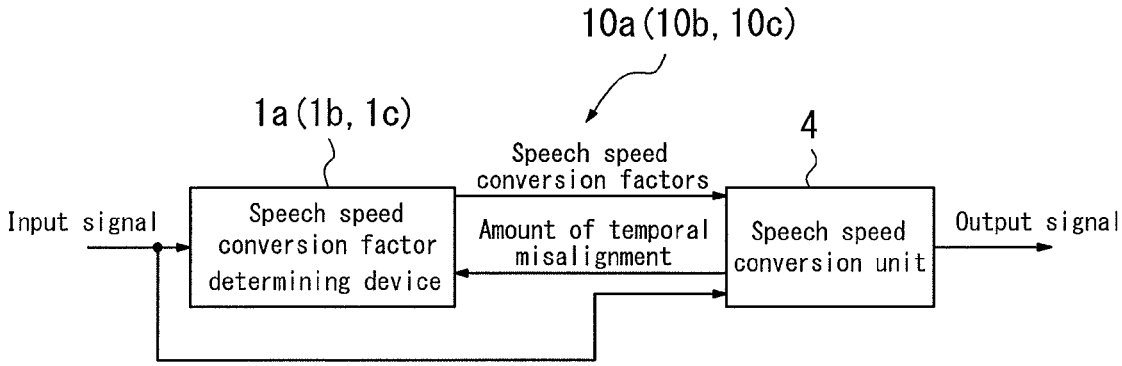
FIG. 4 is a block diagram illustrating the configuration of a speech speed conversion device according to Embodiment 1 of the present invention.

Next, a speech speed conversion device is described with reference to FIG. 4. FIG. 4 is a block diagram illustrating the configuration of a speech speed conversion device according to Embodiment 1 of the present invention. A speech speed conversion device 10*a* is provided with the above-described speech speed conversion factor determining device 1*a* and with a speech speed conversion unit 4. The speech speed conversion unit 4 converts the speech speed of an input signal in accordance with the speech speed conversion factors determined by the speech speed conversion factor determining device 1*a*.

When the speech speed conversion unit 4 needs to operate in real time and perform speech speed conversion sequentially for an input signal, then upon provision of a required playback time length of the entire input signal or of each portion in the divided input signal, for each given time interval, the speech speed conversion unit 4 compares, on a signal time series, a target signal to be output when expanding or contracting the input signal by a uniform factor with a converted signal yielded by converting the input signal at the speech speed conversion factor and returns information on the temporal misalignment to the speech speed conversion factor determining device 1*a*. The speech speed conversion factor fine adjustment unit 140 in the speech speed conversion factor determining device 1*a* readjusts the subsequent speech speed conversion factors in accordance with the amount of misalignment.

In other words, at time intervals Lm, the speech speed conversion unit 4 compares, on the signal time series, a signal to be output when every past portion of the input signal was expanded or contracted uniformly by the playback rate conversion factor $\alpha$ with a signal output after speech speed conversion at an adaptive speech speed conversion factor in accordance with the actual $\alpha_n$ output by the speech speed conversion factor determining device 1*a*. At that point in time, when the output signal for adaptive speech speed conversion corresponds to voice content that is temporally before the hypothetical output signal that is expanded or contracted by uniform speech speed conversion (which occurs when the playback rate conversion factor $\alpha$ is less than 1), the speech speed conversion unit 4 returns information on the amount of temporal misalignment to the speech speed conversion factor fine adjustment unit 140 in the speech speed conversion factor determining device 1*a*. In accordance with the amount of misalignment, the speech speed conversion factor fine adjustment unit 140 adds a fine adjustment by shifting the speech speed conversion factor $\alpha_n$ provided to each subsequent voice interval slightly towards a higher speed.

When the signal output after speech speed conversion at the adaptive speech speed conversion factor in accordance with the actual $\alpha_n$ output by the speech speed conversion factor determining device 1*a* corresponds to voice content that is temporally after the hypothetical output signal that is expanded or contracted by uniform speech speed conversion (which can occur when the playback rate conversion factor $\alpha$ is either less than or greater than 1), the speech speed conversion unit 4 returns information on the amount of temporal misalignment to the speech speed conversion factor fine adjustment unit 140 in the speech speed conversion factor determining device 1*a*, and in accordance with the amount of misalignment, the speech speed conversion factor fine adjustment unit 140 adds a fine adjustment by shifting the speech speed conversion factor $\alpha_n$ provided to each subsequent voice interval slightly towards a lower speed.

In this way, the speech speed conversion device 10*a* maintains as small of a temporal misalignment as possible between the signal output after speech speed conversion at an adaptive speech speed conversion factor and voice that is hypothetically converted uniformly at the playback rate conversion factor $\alpha$. As a result, the input-output relation for successive signals can be maintained during real time operation of the speech speed conversion factor determining device 1*a* and the speech speed conversion unit 4. Accordingly, when it is necessary to output a speech speed converted signal immediately for a signal successively input into the speech speed conversion device 10*a*, it is possible to configure this speech speed conversion device as a real time system.

Here, a computer may be suitably used to function as the speech speed conversion factor determining device 1*a* or the speech speed conversion device 10*a*. Such a computer may be implemented by storing a program describing the processing that achieves the functions of the speech speed conversion factor determining device 1*a* in a storage unit of the computer and having the central processing unit (CPU) of the computer read and execute the program.

In this way, the speech speed conversion factor determining device 1*a* and the speech speed conversion device 10*a* can be caused to operate as a program on the personal computer or an application running on a mobile device such as a portable music player or a smartphone.

Furthermore, the program describing the processing can be recorded on a computer-readable storage medium such as a DVD or a CD-ROM, and the storage medium can be distributed by sale, transfer, loan, or the like. The program can also be distributed by being stored in a storage unit of a server on, for example, an IP network or other network and transferred over the network from the server to another computer.

For example, the computer that executes such a program can also temporarily store, in its own storage unit, the program recorded on a storage medium or transferred from the server. As another embodiment of this program, a computer may read a program directly from a portable storage medium and execute processing in accordance with the program. Furthermore, each time the program is transferred from a server to a computer, the computer may execute processing in accordance with the successively received program.

Embodiment 2

Next, a speech speed conversion factor determining device according to Embodiment 2 of the present invention is described. Constituent elements that are the same as those of Embodiment 1 are provided with the same reference numbers, and a description thereof is omitted.

Figure 5:
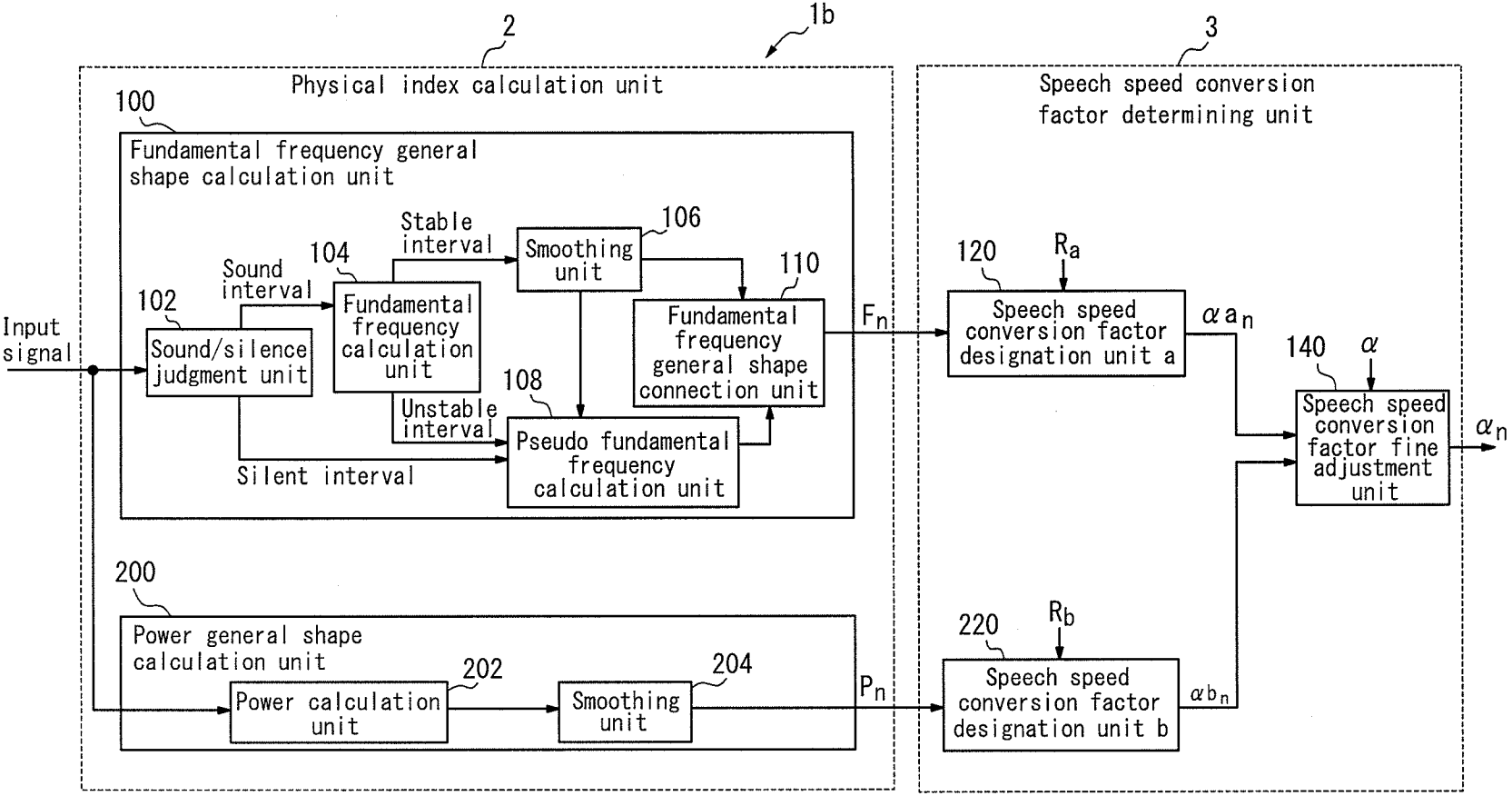
FIG. 5 is a block diagram illustrating the configuration of a speech speed conversion factor determining device according to Embodiment 2 of the present invention.

FIG. 5 is a block diagram illustrating the configuration of a speech speed conversion factor determining device according to Embodiment 2 of the present invention. Like the speech speed conversion factor determining device 1*a* of Embodiment 1, the speech speed conversion factor determining device 1*b* of the present embodiment is provided with the physical index calculation unit 2, which calculates a physical index of an input signal for each segment of the input signal divided by unit time, and with the speech speed conversion factor determining unit 3, which determines the speech speed conversion factor $\alpha_n$ to be designated for each segment of the input signal based on the physical index input from the physical index calculation unit 2.

As compared to the speech speed conversion factor determining device 1*a* of Embodiment 1 (see FIG. 1), the speech speed conversion factor determining device 1*b* of Embodiment 2 differs in that the physical index calculation unit 2 is further provided with a power general shape calculation unit 200, and the speech speed conversion factor determining unit 3 is further provided with a second speech speed conversion factor designation unit (speech speed conversion factor designation unit b) 220. The power general shape calculation unit 200 includes a power calculation unit 202 and a smoothing unit 204.

The speech speed conversion factor determining device 1*b* of the present embodiment comprehensively uses two "physical indices", i.e. $F_n$, which represents the general shape of the fundamental frequency of an input signal per unit time, and $P_n$, which represents the general shape of change in the power of the input signal per unit time, to determine the speech speed conversion factor $\alpha_n$ to be designated for each segment of the input signal and to perform speech speed conversion, and then to generate and output a speech speed converted output signal.

Since the speech speed conversion factor determining device 1*b* of Embodiment 2 uses two physical indices, the first speech speed conversion factor designation unit (speech speed conversion factor designation unit a) 120 of Embodiment 2 takes into account the rate of contribution to the speech speed by the sampled value $F_n$ of the general shape of the fundamental frequency and calculates the speech speed conversion factors $\alpha a_n$ using, for example, equations (5) through (7) below.

Math 3

$$\alpha a_n = F'n^{-Ra} \tag{5}$$

$$\alpha a_n = K^{(1.0-F'_n)\cdot Ra} \tag{6}$$

$$\alpha a_n = Ra\cdot K^{(1.0-F'_n)} \tag{7}$$

In these equations, Ra is the rate of contribution to the speech speed designated by the sampled values $F_n$ of the general shape of the fundamental frequency, and $0 \le Ra \le 1$. Furthermore, along with the provisional expansion/contraction ratios $F'_n$, K is a constant for adjusting the range for lowering and raising the speech speed. For example, K is from 1.4 to 2.0.

Calculation of Physical Index $P_n$

Next, the calculation of the physical index $P_n$ is described with reference to FIGS. 5 and 6. FIG. 5 illustrates an example of calculating the general shape of the power and of determining provisional expansion/contraction ratios.

Figures 6A, 6B, 6C:
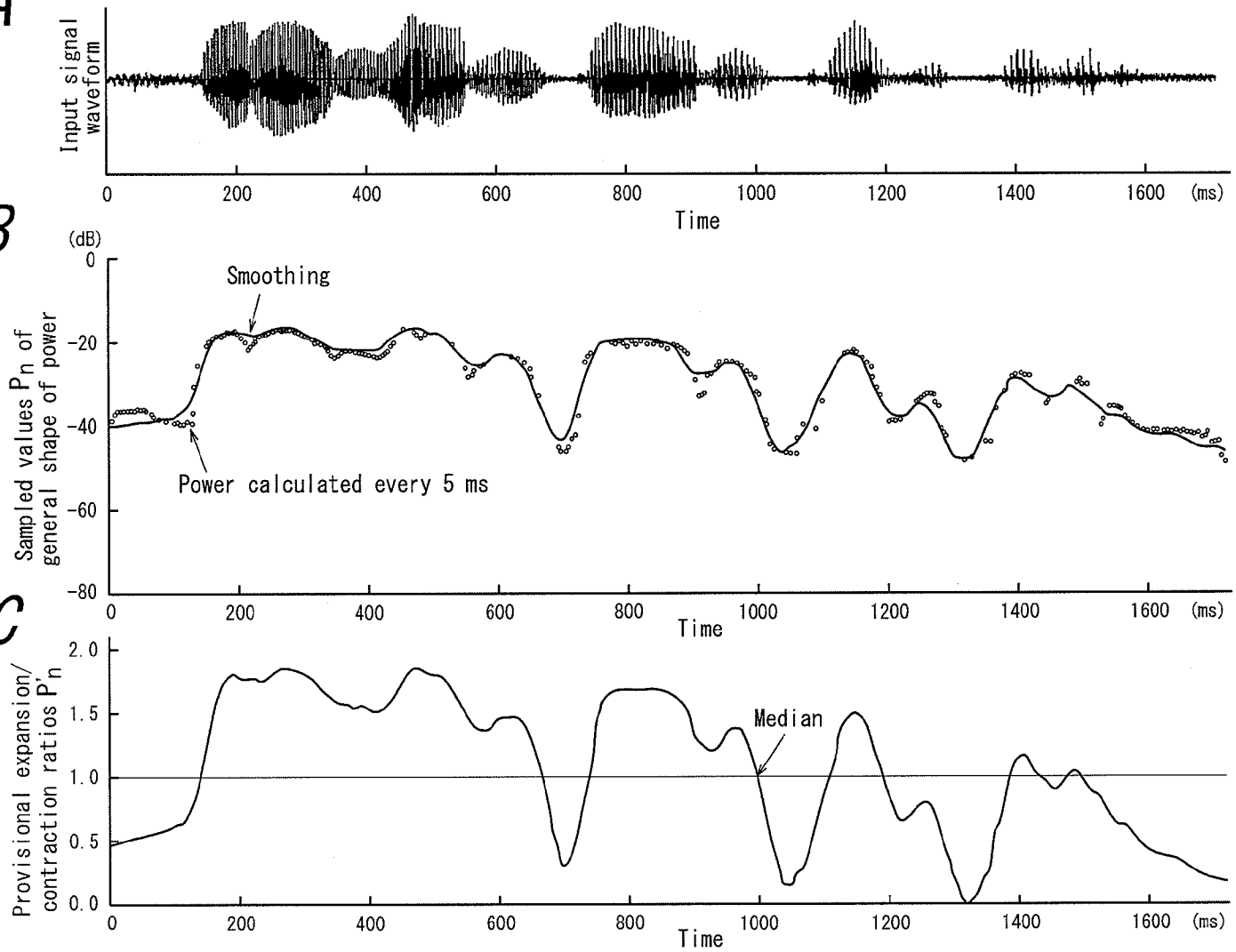
FIGS. 6A, 6B and 6C illustrate an example of calculating the general shape of power and of determining a provisional expansion/contraction ratio.

The power calculation unit 202 calculates the power of the input signal each unit time (5 ms) and outputs the result to the smoothing unit 204. Power can be calculated by a general method that weights the input signal waveform with a window function, such as a hamming window with a time width of approximately 20 ms, and then calculates the sum of squares of the sampled values. The method described using equation (1) provides a specific example of a calculation method. FIG. 6A illustrates an example of an input signal waveform. FIG. 6B shows a plot of the power per unit time for the input signal illustrated in FIG. 6A.

So that the power input from the power calculation unit 202 forms a smoother trajectory, the smoothing unit 204 smoothes the trajectory of the power calculated for each unit time, calculates values $P_n$ sampled at each unit time from the general shape of the power (hereinafter referred to as "sampled values of the general shape of the power"), and outputs $P_n$ to the second speech speed conversion factor designation unit (speech speed conversion factor designation unit b) 220. For this smoothing, a low pass filter with a cutoff frequency of approximately 3 to 6 Hz is suitable.

Determination of Speech Speed Conversion Factor

Next, the determination of the speech speed conversion factors is described with reference to FIGS. 5 and 6. Basically, the second speech speed conversion factor designation unit (speech speed conversion factor designation unit b) 220 makes the speech speed conversion factors relatively smaller (slower speech speed) in a portion where the sampled values $P_n$ of the general shape of the power are large and makes the speech speed conversion factors relatively larger (faster speech speed) in a portion where the sampled values $P_n$ of the general shape of the power are small. In other words, the relative speech speed conversion factors decrease in a portion where the voice (power) is loud and increases in a portion where the voice is soft. This is because in a portion where the voice is loud, meaning is being stressed, and that portion of the sentence may be important. It can be predicted that making the speech speed relatively slow facilitates understanding of the words at the converted speech speed. Furthermore, it is considered that a relatively fast speech speed will have little adverse effect upon understanding in a silent interval.

Next, a few examples of a method for determining a specific speech speed factors using the sampled values $P_n$ of the general shape of the power are described. When the number of sampled values $P_n$ of the general shape of the power is limited, the second speech speed conversion factor designation unit (speech speed conversion factor designation unit b) 220 uses the median to normalize all of the sampled values. For example, the second speech speed conversion factor designation unit (speech speed conversion factor designation unit b) 220 treats the median as 1.0, and when the difference is larger between the maximum value and the median than between the minimum value and the median, treats the maximum value as 2.0, allocates new values between 0 and 2 to all of the sampled values $P_n$ of the general shape of the power by proportional distribution, and assigns the new value to be a provisional expansion/contraction ratio $P'_n$ for each unit time (5 ms). When the difference is larger between the minimum value and the median than between the maximum value and the median, the second speech speed conversion factor designation unit (speech speed conversion factor designation unit b) 220 considers the minimum value to be 0.0 and performs similar operations. Similar operations may also be performed after calculating $\log P_n$ for all sampled values $P_n$ of the general shape of the power. Furthermore, instead of the median, the average of all of the sampled values $P_n$ of the general shape of the power or the average of the maximum value and the minimum value may be used. FIG. 6C illustrates the provisional expansion/contraction ratios $P'_n$ for the sampled values $P_n$ of the general shape of the power illustrated in FIG. 6B. In this example, since the power (vertical axis) is digitalized, $P'_n$ is calculated based on the general shape of the power given by $\log P_n$.

When the speech speed conversion factor determining device 1*b* needs to operate in real time and perform speech speed conversion sequentially for an input signal, the number of sampled values $P_n$ of the general shape of the power is not determined. Therefore, the second speech speed conversion factor designation unit (speech speed conversion factor designation unit b) 220 may store the sampled values $P_n$ of the general shape of the power for the past three seconds, for example, and use the maximum value, the minimum value, the median, or the like to normalize the current sampled value $P_n$ of the general shape of the power and assign these values as the provisional expansion/contraction ratios $P'_n$. However, in this case, the smoothing unit 204 in the physical index calculation unit 2 only uses the calculation results for the past and present power to perform the smoothing computation.

Next, calculation of speech speed conversion factors $\alpha b_n$ corresponding to the values of the provisional expansion/contraction ratios is explained. As described above, the values of the provisional expansion/contraction ratios $P'_n$ is normalized between 0 and 2, and therefore the second speech speed conversion factor designation unit (speech speed conversion factor designation unit b) 220 calculates the speech speed conversion factors $\alpha b_n$ using, for example, equations (8) through (10) below.

Math 4

$$\alpha b_n = P'n^{-Rb} \tag{8}$$

$$\alpha b_n = K^{(1.0-P'_n)\cdot Rb} \tag{9}$$

$$\alpha b_n = Rb\cdot K^{(1.0-P'_n)} \tag{10}$$

In these equations, Rb is the rate of contribution to the speech speed designated by the sampled values $P_n$ of the general shape of the power, and $0 \le Rb \le 1$. Furthermore, along with the provisional expansion/contraction ratio $P'_n$, K is a constant for adjusting the range for lowering and raising the speech speed. For example, K is from 1.4 to 2.0.

When the input signal is a broadcast, for example, and the genre of the program (news, documentary, drama, variety, comic storytelling/stand-up comedy, or the like) is known, optimizing a distribution factor for the values of the rate of contribution Ra in equations (5) through (7) and the rate of contribution Rb in equations (8) through (10) in accordance with the genre allows for adaptive speech speed conversion that is easier to hear and is more natural. For example, for news, Ra=0.7 and Rb=0.3. For a documentary or drama, Ra=0.5 and Rb=0.5. For comic storytelling/stand-up comedy, Ra=0.3 and Rb=0.7, and so forth. Furthermore, adjusting the values of the rates of contribution Ra and Rb depending on differences in the language targeted for speech speed conversion can achieve converted voice that sounds more natural in each language.

Finally, an example of operations by the speech speed conversion factor fine adjustment unit 140 is described. The $n^{th}$ speech speed conversion factor $\alpha_n$ counting from the start of the input signal by unit time (5 ms) is basically $\alpha_n = \alpha a_n \times \alpha b_n$ when using equations (5), (6), (8), and (9) and $\alpha_n = \alpha a_n + \alpha b_n$ when using equations (7) and (10). However, in the case that the playback rate conversion factor $\alpha$ is provided, this factor is finely adjusted by the following steps. Any value, for example from 0.5 to 5.0, can be set as the playback rate conversion factor $\alpha$.

In the case that the playback rate conversion factor $\alpha$ is provided, then the length of the entire signal after conversion is expected to be $L/\alpha$, where the length of the entire input signal is L (in units of seconds). First, based on the speech speed conversion factors $\alpha a_n$ and $\alpha b_n$, the speech speed conversion factor fine adjustment unit 140 calculates a speech speed conversion factor $\alpha ab_n$ letting $\alpha ab_n = \alpha a_n \times \alpha b_n$ when using equations (5), (6), (8), and (9) and letting $\alpha ab_n = \alpha a_n + \alpha b_n$ when using equations (7) and (10), performs speech speed conversion on all of the input signal intervals, and calculates the length $L_0$ of the entire converted voice after connection.

Next, using equation (11) below, the speech speed conversion factors $\alpha ab_n$ to determine the final speech speed conversion factor $\alpha_n$ is finely adjusted, and thereby the length of the entire converted signal is aligned with the required playback time length.

$$\alpha_n = \alpha ab_n \times L_0/(L/\alpha) \quad (11)$$

If as frequently as possible the length is made to correspond to the same timing as when voice is converted uniformly at the playback rate conversion factor $\alpha$, then as in Embodiment 1, the speech speed conversion factor fine adjustment unit 140 can modify $\alpha_n$ by performing fine adjustment not with respect to the length L of the entire input signal, but rather the length of voice divided into shorter units. For example, when L is divisible into M intervals, i.e. $L=L_1+L_2+L_M$, the speech speed conversion factor fine adjustment unit 140 divides the input signal waveform into intervals $L_1, L_2, \ldots, L_M$, and in each divided interval, for the $m^{th}$ interval, first converts the speech speed of the $m^{th}$ interval using the speech speed conversion factor $\alpha ab_n$ ($\alpha a_n \times \alpha b_n$ or $\alpha a_n + \alpha b_n$) of each portion per unit time (5 ms) for that interval and calculates the partial length $Lm_0$ of the converted voice after connection. The speech speed conversion factor fine adjustment unit 140 then calculates the speech speed conversion factors $\alpha_n$ by substituting Lm for L and $Lm_0$ for $L_0$ into equation (11) and performs speech speed conversion again in order to perform fine adjustment. Note that the speech speed conversion (waveform expansion/contraction) method for implementing the speech speed conversion factors $\alpha_n$ may be the same as in Embodiment 1.

Figure 7:
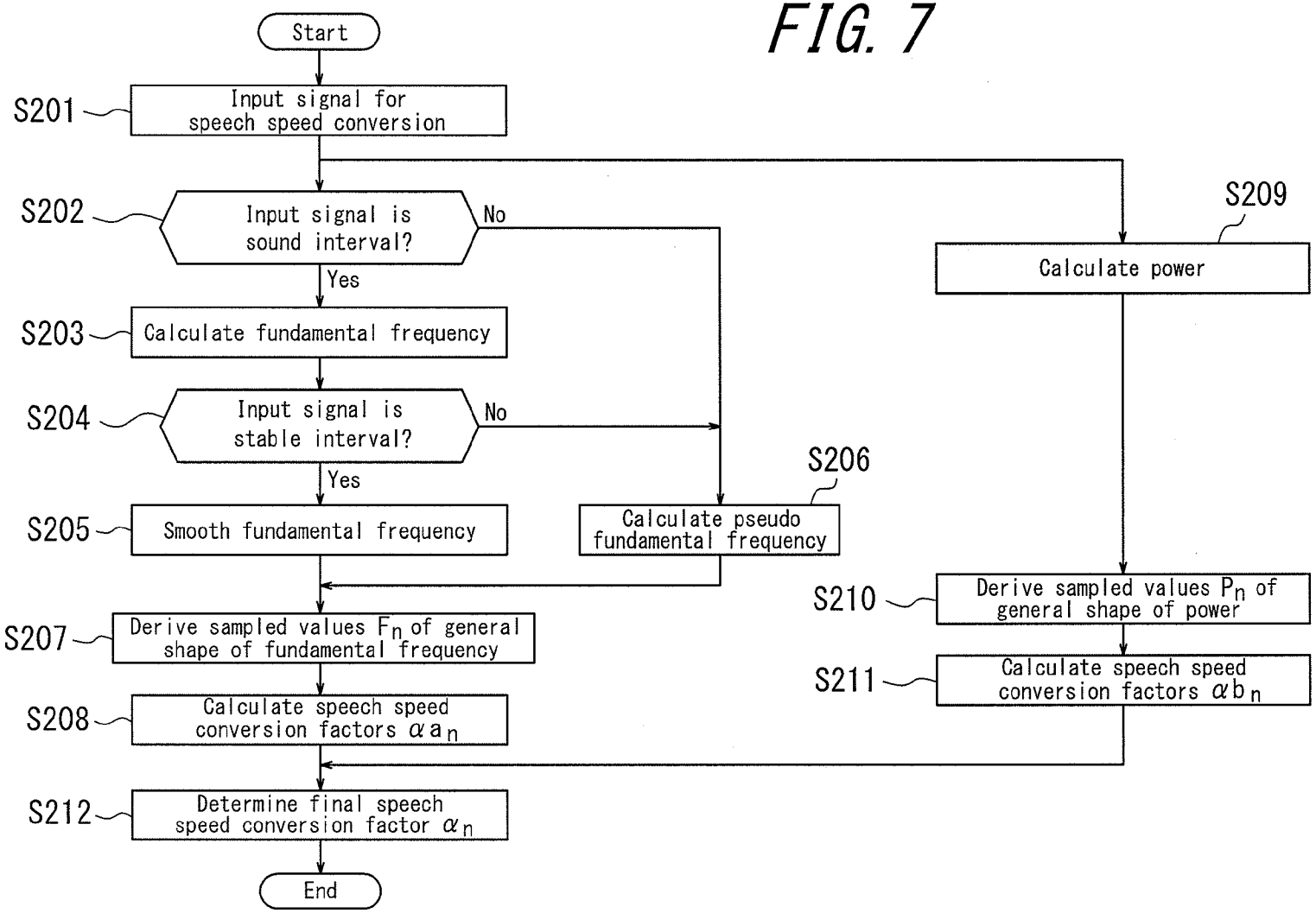
FIG. 7 is a flowchart illustrating operations of the speech speed conversion factor determining device according to Embodiment 2 of the present invention.

FIG. 7 is a flowchart illustrating operations of the speech speed conversion factor determining device 1*b* in Embodiment 2. Since steps S201 to S208 are the same as steps S101 to S108 for operations of the speech speed conversion factor determining device 1*a* in Embodiment 1 shown in FIG. 3, a description thereof is omitted. Upon input of a signal for speech speed conversion, the speech speed conversion factor determining device 1*b* uses the power calculation unit 202 to calculate the power of the input signal (step S209). The speech speed conversion factor determining device 1*b* uses the smoothing unit 204 to smooth the trajectory of the calculated power and calculate the sampled values $P_n$ of the general shape of the power (step S210). Next, the speech speed conversion factor determining device 1*b* uses the second speech speed conversion factor designation unit (speech speed conversion factor designation unit b) 220 to calculate the speech speed conversion factors $\alpha b_n$ based on the sampled values $P_n$ of the general shape of the power (step S211). Finally, the speech speed conversion factor determining device 1*b* uses the speech speed conversion factor fine adjustment unit 140 to calculate the speech speed conversion factors $\alpha_n$ from the speech speed conversion factors $\alpha a_n$ and $\alpha b_n$. In the case that the playback rate conversion factors a are provided, $\alpha_n$ is finely adjusted to yield the final speech speed conversion factor (step S212).

In this way, according to the speech speed conversion factor determining device 1*b* of the present embodiment, by calculating the speech speed conversion factor $\alpha_n$ based on the fundamental frequency and the power, it is possible to determine to raise the speech speed in, for example, a portion with only background sound (such as background music) in which the pseudo fundamental frequency is small even though the power is large.

Furthermore, adding the power value to the speech speed control has the following advantage. Normally, pitch and loudness of voice are positively correlated, and power is also large in a portion with a high fundamental frequency. Such a portion is often a vowel, and the fundamental frequency is calculated stably in a vowel. Accordingly, by lowering the speech speed where the fundamental frequency and power values are large, the probability of lowering the speech speed mainly for vowels is high. It is known that when comparing a slow speech speed with a high speech speed in an actual person's speech, mainly vowels are expanded or contracted (for example, see the $148^{th}$ Meeting of the Acoustical Society of America, 4pSC3, the abstract of which is published in the Journal of the Acoustical Society of America, Vol. 116, No. 4, Pt. 2 of 2, p. 2628). Accordingly, this method allows for more natural sounding adaptive speech speed conversion.

The following is yet another advantage. Japanese and Chinese have "pitch accent", with a strong tendency to distinguish between homonyms and emphasize meaning through changes in pitch. On the other hand, western languages have "stress accent" and are said to control the sense of rhythm in words and to emphasize meaning through changes in volume. Accordingly, adding values for both pitch and volume to adaptive control of speech speed allows for optimization for a variety of languages.

When the voice targeted for speech speed conversion is voice in a broadcast, and the genre of the program (news, documentary, drama, variety, comic storytelling/stand-up comedy) is included as metadata, which has become highly developed in recent years, then optimizing the distribution factors for the multipliers or exponents (rates of contribution) applied to the speech speed conversion factors in correspondence with the genre can achieve adaptive speech speed conversion that is easier to hear and is more natural.

Like the speech speed conversion device 10*a* of Embodiment 1, a speech speed conversion device 10*b* of Embodiment 2 is provided with the above-described speech speed conversion factor determining device 1*b* and with the speech speed conversion unit 4, which performs speech speed conversion on an input signal in accordance with the speech speed conversion factors determined by the speech speed conversion factor determining device 1*b*. Operations when the speech speed conversion device 4 needs to operate in real time are similar to those of Embodiment 1.

Furthermore, as in Embodiment 1, a computer may be suitably used to function as the speech speed conversion factor determining device 1*b* or the speech speed conversion device 10*b*. Such a computer may be implemented by storing a program describing the processing that achieves the functions of the speech speed conversion factor determining device 1*b* in a storage unit of the computer and having the central processing unit (CPU) of the computer read and execute the program.

Furthermore, the program describing the processing can be recorded on a computer-readable storage medium such as a DVD or a CD-ROM, and the storage medium can be distributed by sale, transfer, loan, or the like. The program can also be distributed by being stored in a storage unit of a server on, for example, an IP network or other network and transferred over the network from the server to another computer.

For example, the computer that executes such a program can also temporarily store, in its own storage unit, the program recorded on a storage medium or transferred from the server. As another embodiment of this program, a computer may read a program directly from a portable storage medium and execute processing in accordance with the program. Furthermore, each time the program is transferred from a server to a computer, the computer may execute processing in accordance with the successively received program.

Embodiment 3

The following describes a speech speed conversion factor determining device according to Embodiment 3, which adds a supplementary means for more stably achieving the effects of adaptive speech speed conversion in the present invention. Constituent elements that are the same as those of Embodiment 2 are provided with the same reference numbers, and a description thereof is omitted.

Figure 8:
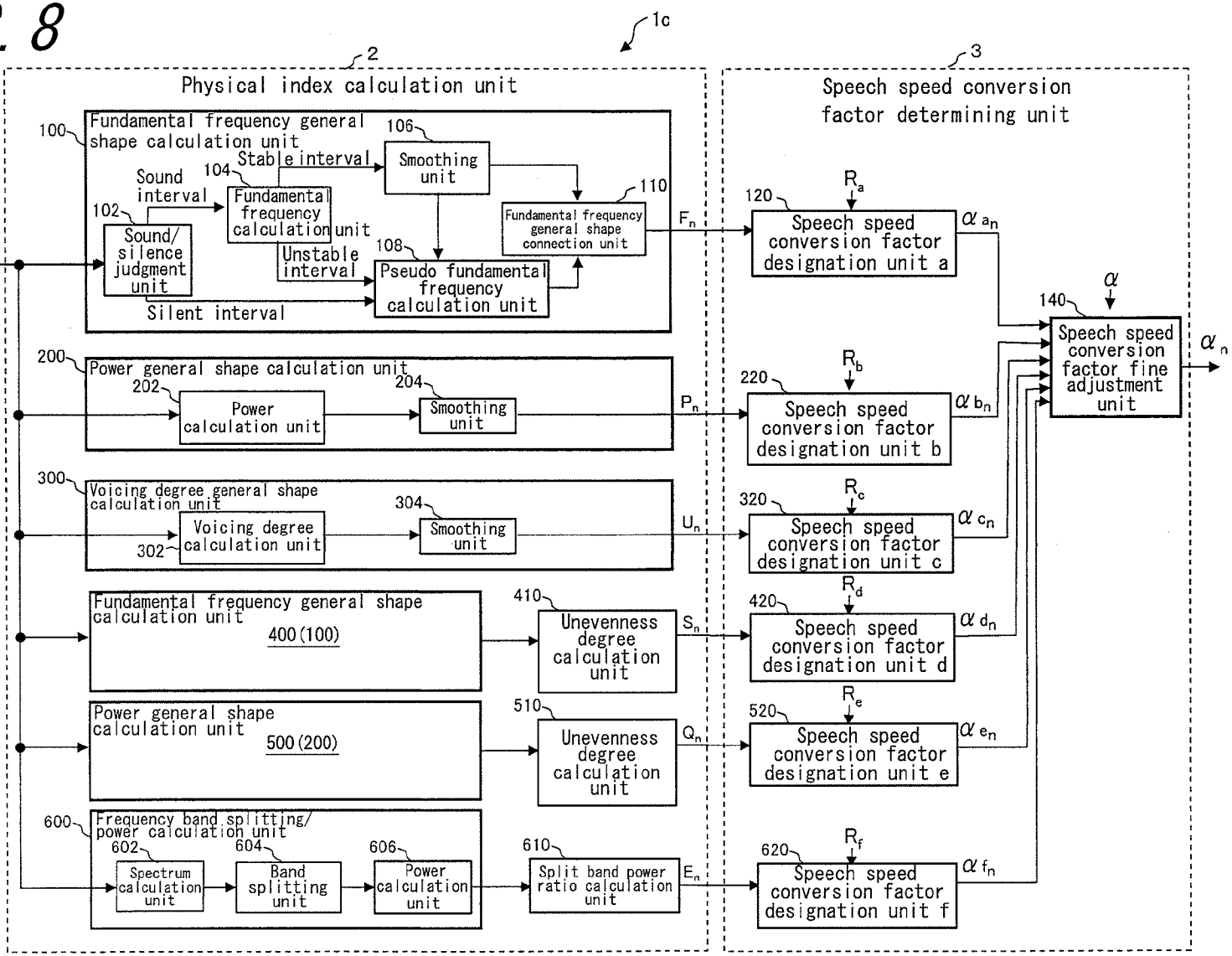
FIG. 8 is a block diagram illustrating the configuration of Embodiment 3 of the present invention.

FIG. 8 is a block diagram illustrating the configuration of a speech speed conversion factor determining device according to Embodiment 3 of the present invention. Like the speech speed conversion factor determining device 1*a* of Embodiment 1 and the speech speed conversion factor determining device 1*b* of Embodiment 2, the speech speed conversion factor determining device 1*c* of the present embodiment is provided with the physical index calculation unit 2, which calculates a physical index of an input signal for each segment of the input signal divided by unit time, and with the speech speed conversion factor determining unit 3, which determines the speech speed conversion factor $\alpha_n$ to be designated for each segment of the input signal based on the physical index input from the physical index calculation unit 2.

As compared to the speech speed conversion factor determining device 1*b* of Embodiment 2 (see FIG. 5), the speech speed conversion factor determining device 1*c* of Embodiment 3 differs in that the physical index calculation unit 2 is further provided with a voicing degree general shape calculation unit 300, a fundamental frequency general shape calculation unit 400, an unevenness degree calculation unit 410, a power general shape calculation unit 500, an unevenness degree calculation unit 510, a frequency band splitting/power calculation unit 600, and a split band power ratio calculation unit 610, which are calculation units for supplemental physical indices, and the speech speed conversion factor determining unit 3 is further provided with a third speech speed conversion factor designation unit (speech speed conversion factor designation unit c) 320, a fourth speech speed conversion factor designation unit (speech speed conversion factor designation unit d) 420, a fifth speech speed conversion factor designation unit (speech speed conversion factor designation unit e) 520, and a sixth speech speed conversion factor designation unit (speech speed conversion factor designation unit f) 620, which are speech speed conversion factor designation units based on supplemental physical indices. The power general shape calculation unit 200 includes a power calculation unit 202 and a smoothing unit 204. The voicing degree general shape calculation unit 300 includes a voicing degree calculation unit 302 and a smoothing unit 304. The frequency band splitting/power calculation unit 600 includes a spectrum calculation unit 602, a band splitting unit 604, and a power calculation unit 606. The internal configuration of the fundamental frequency general shape calculation unit 400 is the same as that of the fundamental frequency general shape calculation unit 100, and the internal configuration of the power general shape calculation unit 500 is the same as that of the power general shape calculation unit 200.

Supplementary Speech Speed Conversion Factor Control Using Voicing Degree

The voicing degree calculation unit 302 calculates an autocorrelation function $R(\tau)$ from an input signal waveform including a mixture of audio and background sound from a broadcast and uses the autocorrelation function $R(\tau)$ to calculate the voicing degrees. The autocorrelation function $R(\tau)$ is derived with the following equation (12), and the voicing degree u is derived with the following equation (13).

Math 5

$$R(\tau) = \frac{1}{K-\tau}\sum_{k=0}^{K-1-\tau} x'(k)\cdot x'(k+\tau) \tag{12}$$

Figure 9A:
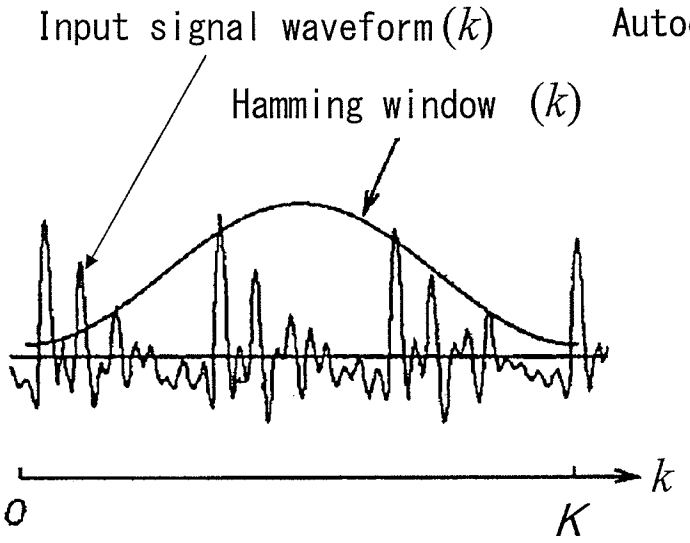
FIGS. 9A and 9B illustrate calculation of an autocorrelation function.

In this equation, x'(k) is a waveform yielded by weighting the input signal waveform x(k) with a window function h(k), such as a hamming window, and x'(k)=h(k)·x(k), as illustrated in FIG. 9A.

$$u=W(\tau)\cdot R(\tau)_{max}/R(0) \tag{13}$$

Figure 9B:
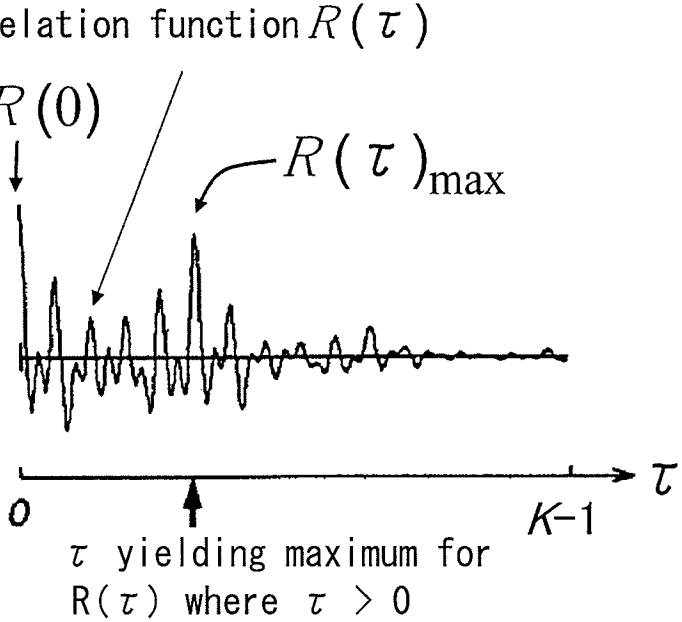

In this equation, $R(\tau)_{max}$ is the maximum value when $\tau>0$, as illustrated in FIG. 9B. $\tau$ is the time lag, and $W(\tau)$ is the weight corresponding to the value of $\tau$ that yields $R(\tau)_{max}$. As an alternative calculation method, the number of zero crossings of the input signal waveform in a unit time (5 ms) can be counted, and the inverse of this count may be used.

The voicing degree u is reliably calculated for each unit time (5 ms) in every portion of the input signal, but the values do not necessarily change smoothly over time. Therefore, the smoothing unit 304 calculates $U_n$, which is a smoothed trajectory of the voicing degrees per unit time input from the voicing degree calculation unit 302 (hereinafter referred to as "sampled values of the general shape of the voicing degrees"), and outputs $U_n$ to the third speech speed conversion factor designation unit (speech speed conversion factor designation unit c) 320. For this smoothing, a low pass filter with a cutoff frequency of approximately 3 to 6 Hz is suitable.

The third speech speed conversion factor designation unit (speech speed conversion factor designation unit c) 320 calculates speech speed conversion factors $\alpha c_n$ in accordance with the sampled values $U_n$ of the general shape of the voicing degrees. The case of using an autocorrelation function is described. In general, the sampled values $U_n$ of the general shape of the voicing degrees are in a range of approximately −0.2 to 1.2. Therefore, when the sampled values $U_n$ of the general shape of the voicing degrees are larger than 0.5, the speech speed is lowered ($\alpha c_n<1.0$), and when $U_n$ is 0.5 or less, the speech speed is raised ($\alpha c_n>1.0$). The third speech speed conversion factor designation unit (speech speed conversion factor designation unit c) 320 calculates the speech speed conversion factors $\alpha c_n$ using, for example, equations (14) through (16) below.

Math 6

$$\alpha c_n=\{(U_n+0.2)/0.7\}^{-Rc} \tag{14}$$

$$\alpha c_n=K^{0.5-U_n)/0.7Rc} \tag{15}$$

$$\alpha c_n=Rc\times K^{(0.5-U_n)/0.7} \tag{16}$$

In equation (14), however, when $U_n<-0.2$, calculation is performed assuming $U_n=-0.2$. In these equations, Re is the rate of contribution to the speech speed conversion factors designated by the general shape of the voicing degrees, and $0\leq Rc\leq 1$. Furthermore, along with the sampled values $U_n$ of the general shape of the voicing degrees, K is a constant for adjusting the range for lowering and raising the speech speed. For example, K is from 1.4 to 2.0.

Supplementary Speech Speed Conversion Factor Control Using Unevenness Degree of General Shape of Fundamental Frequency Next, an example of operations to use the unevenness degrees of the general shape of the fundamental frequency is described. The fundamental frequency general shape calculation unit 400, which operates in the same way as the fundamental frequency general shape calculation unit 100 described in Embodiment 1, outputs the sampled values $F_n$ of the general shape of the fundamental frequency each unit time.

The unevenness degree calculation unit (fundamental frequency unevenness degree calculation unit) 410 calculates an unevenness degrees $S_n$ representing the trend of change in the sampled values $F_n$ of the general shape of the fundamental frequency (hereinafter referred to as "unevenness degrees of the general shape of the fundamental frequency"). For example, for a sampled value $F_n$ of the general shape of the fundamental frequency, the unevenness degree calculation unit (fundamental frequency unevenness degree calculation unit) 410 calculates the degree of a local maximum or local minimum by using a value $Fb_n$ 30 ms earlier and a value $Fa_n$ 30 ms later and setting the average of $(F_n-Fb_n)$ and $(F_n-Fa_n)$ as the unevenness degree $S_n$ of the general shape of the fundamental frequency. In this case, in an interval in which the trajectory is flat, or is monotonically increasing or monotonically decreasing, the degree of the local maximum or local minimum is close to zero. Note that all of the unevenness degrees $S_n$ of the general shape of the fundamental frequency are normalized by being divided by the largest among the absolute values of the unevenness degrees $S_n$ of the general shape of the fundamental frequency. Accordingly, the unevenness degree $S_n$ of the general shape of the fundamental frequency, which indicates the degree of the local maximum or local minimum, is a value between −1 and 1.

When using the sampled values $F_n$ of the general shape of the fundamental frequency 5 ms (one sample) earlier and later, this method is equivalent to calculating the second difference of the sampled value $F_n$ of the general shape of the fundamental frequency. In other words, the second difference $F''n=(F_n-F_{n-1})-(F_{n-1}-F_{n-2})$ is first calculated for all of the sampled values $F_n$ of the general shape of the fundamental frequency, and next, using the largest absolute value, every F"n is normalized and the sign is inverted to yield the unevenness degree $S_n$ of the general shape of the fundamental frequency. As a result, the value of the unevenness degree $S_n$ of the general shape of the fundamental frequency is between −1 and 1. As is well known, the second difference of the function has a positive value at a local minimum of a function and a negative value at a local maximum. As the absolute value increases, the degree of the local minimum/maximum is greater (the degree of unevenness is sharper). For an arbitrary continuous curve, the second difference is considered equivalent to the second derivative, and therefore $S_n$ can be treated as the unevenness degree of the general shape of the fundamental frequency.

In accordance with the unevenness degrees $S_n$ of the general shape of the fundamental frequency per unit time (5 ms), the fourth speech speed conversion factor designation unit (speech speed conversion factor designation unit d) 420 lowers the speech speed when $S_n$ is a positive value and raises the speech speed when $S_n$ is a negative value, calculating speech speed conversion factors $\alpha d_n$ using, for example, equations (17) through (19) below.

Math 7

$$\alpha d_n=(S_n+1)^{-Rd} \tag{17}$$

$$\alpha d_n=K^{-S_n \cdot Rd} \tag{18}$$

$$\alpha d_n=Rd\times K^{-S_n} \tag{19}$$

In these equations, Rd is the rate of contribution to the speech speed conversion factors designated by the unevenness degrees of the general shape of the fundamental frequency, and $0\leq Rd\leq 1$. Furthermore, along with the unevenness degrees $S_n$ of the general shape of the fundamental frequency, K is a constant for adjusting the range for lowering and raising the speech speed. For example, K is from 1.4 to 2.0.

Supplementary Speech Speed Conversion Factor Control Using Unevenness Degree of General Shape of Power Next, an example of operations to use the unevenness degrees of the general shape of the power is described. The basic method is the same as when using the unevenness degrees of the general shape of the fundamental frequency. For the output from the power general shape calculation unit 500 for an input signal, the unevenness degree calculation unit 510 calculates the unevenness degrees of the peaks and valleys. The fundamental frequency general shape calculation unit 500, which operates in the same way as the above-described power general shape calculation unit 200, outputs the sampled values $P_n$ of the general shape of the power each unit time (5 ms).

The unevenness degree calculation unit (power unevenness degree calculation unit) 510 calculates unevenness degrees $Q_n$ representing the trend of change in the sampled values $P_n$ of the general shape of the power (hereinafter referred to as "unevenness degrees of the general shape of the power"). For example, for a sampled value $P_n$ of the general shape of the power, the degree of a local maximum or local minimum is calculated by using a value $Pb_n$ 30 ms earlier and a value $Pa_n$ 30 ms later and setting the average of $(P_n-Pb_n)$ and $(P_n-Pa_n)$ as the unevenness degree $Q_n$ of the general shape of the power. In this case, in an interval in which the trajectory is flat, or is monotonically increasing or monotonically decreasing, the degree of the local maximum or local minimum is close to zero. Note that all of the unevenness degrees $Q_n$ of the general shape of the power are normalized by being divided by the largest among the absolute values of the unevenness degrees $Q_n$ of the general shape of the power. Accordingly, the unevenness degree $S_n$ of the general shape of the power, which indicates the degree of the local maximum or local minimum, is a value between −1 and 1.

Like the sampled values of the general shape of the fundamental frequency, when using the sampled values $P_n$ of the general shape of the power 5 ms (one sample) earlier and later, this method is equivalent to calculating the second difference of the sampled values $P_n$ of the general shape of the power. In other words, the second difference $P''n=(P_n-P_{n-1})\ (P_{n-1}-P_{n-2})$ is calculated for all of the sampled values $P_n$ of the general shape of the power, and next, using the largest absolute value, every P"n is normalized and the sign is inverted to yield the unevenness degree $Q_n$ of the general shape of the power. As a result, the values of the unevenness degrees $Q_n$ of the general shape of the power are between −1 and 1.

In accordance with the unevenness degrees $Q_n$ of the general shape of the power per unit time (5 ms), the fifth speech speed conversion factor designation unit (speech speed conversion factor designation unit e) 520 lowers the speech speed when $Q_n$ is a positive value and raises the speech speed when $Q_n$ is a negative value, calculating speech speed conversion factors $\alpha e_n$ using, for example, equations (20) through (22) below.

Math 8

$$\alpha e_n=(Q_n+1)^{-Re} \tag{20}$$

$$\alpha e_n=K^{-Q_n \cdot Re} \tag{21}$$

$$\alpha e_n=Re\times K^{-Q_n} \tag{22}$$

In these equations, Re is the rate of contribution to the speech speed conversion factors designated by the unevenness degrees of the general shape of the power, and $0 \leq Re \leq 1$. Furthermore, along with the unevenness degrees $Q_n$ of the general shape of the power, K is a constant for adjusting the range for lowering and raising the speech speed. For example, K is from 1.4 to 2.0.

Supplementary Speech Speed Conversion Factor Control Using Power Ratio of Split Frequency Bands Next, an example of operations to use the power ratio of split frequency bands is described. The frequency band splitting/power calculation unit 600 calculates the power spectrum of the input signal in order to calculate the normalized power in a first frequency band and the normalized power in a higher frequency band than the first frequency band.

For an input signal, the spectrum calculation unit 602 converts the waveform in the time domain to the frequency domain each unit time (5 ms) using a Fast Fourier Transform (FFT) or the like and calculates the logarithmic power spectrum (units: dB) for each frequency.

The band splitting unit 604 splits the power spectrum input from the spectrum calculation unit 602 into a plurality of frequency bands. For example, the power spectrum is split into a frequency band B1: 0 to 300 Hz, frequency band B2: 300 to 1500 Hz, frequency band B3: 1500 to 3000 Hz, frequency band B4: 3000 to 8000 Hz, and frequency band B5: 8000 Hz and above.

The power calculation unit 606 calculates the normalized power for a lower frequency band and for a higher frequency band. For example, frequency band B2 is selected as the lower frequency band, and frequency band B4 is selected as the higher frequency band. The normalized power is calculated by summing the values of the power spectrum bins included in each frequency band and then dividing by the number of bins. The power calculation unit 606 outputs the normalized power calculated for frequency band B2 and frequency band B4 to the split band power ratio calculation unit 610.

Since the lower normalized power and the higher normalized power input from the power calculation unit 606 have already been made logarithmic, the split band power ratio calculation unit 610 subtracts the higher normalized power from the lower normalized power to yield the difference therebetween (i.e. to calculate the normalized power ratios). Normally, this difference is approximately 10 dB to 40 dB. The split band power ratio calculation unit 610 then smoothes the trajectory of the values calculated each unit time (5 ms), calculates the normalized power ratios $E_n$ for the split frequency bands (hereinafter referred to as "split band power ratios"), and outputs $E_n$ to the sixth speech speed conversion factor designation unit (speech speed conversion factor designation unit f) 620. For this smoothing, a low pass filter with a cutoff frequency of approximately 3 to 6 Hz is suitable.

The sixth speech speed conversion factor designation unit (speech speed conversion factor designation unit f) 620 lowers the speech speed when the split band power ratios $E_n$ are greater than 25 dB and raises the speech speed when the split band power ratios $E_n$ are 25 dB or less, calculating speech speed conversion factors $\alpha f_n$ using, for example, equations (23) through (25) below.

Math 9

$$\alpha f_n = \{1-(25-E_n)/15\}^{-Rf} \tag{23}$$

$$\alpha f_n = K^{(25-E_n)/15Rf} \tag{24}$$

$$\alpha f_n = Rf \times K^{(25-E_n)/15} \tag{25}$$

In equation (23), however, when $E_n < 10$ (units: dB), calculation is performed assuming $E_n = 10$. In these equations, Rf is the rate of contribution to the speech speed conversion factors designated by the split band power ratios, and $0 \leq Rf \leq 1$. Furthermore, along with the split band power ratios $E_n$, K is a constant for adjusting the range for lowering and raising the speech speed. For example, K is from 1.4 to 2.0.

The values of Rc in equations (14) through (16), Rd in equations (17) through (19), Re in equations (20) through (22), and Rf in equations (23) through (25) are adjusted and used in the same way as Ra in equations (5) through (7) and Rb in equations (8) through (10). When the input signal is a broadcast, for example, and the genre of the program (news, documentary, drama, variety, comic storytelling/stand-up comedy) is known, optimizing a distribution factor for the values in accordance with the genre allows for adaptive speech speed conversion that is easier to hear and is more natural. For example, for news, Ra=0.3, Rb=0.1, Rc=0.1, Rd=0.3, Re=0.1, and Rf=0.1. For a documentary or drama, Ra=0.2, Rb=0.2, Rc=0.1, Rd=0.2, Re=0.2, and Rf=0.1. For comic storytelling/stand-up comedy, Ra=0.1, Rb=0.1, Rc=0.3, Rd=0.2, Re=0.2, and Rf=0.1, and so forth.

Furthermore, adjusting the values of the rates of contribution Ra, Rb, Rc, Rd, Re, and Rf depending on differences in the language for speech speed conversion can achieve converted voice that sounds more natural in each language.

Fine Adjustment of Speech Speed Conversion Factor

Finally, an example of operations by the speech speed conversion factor fine adjustment unit 140 is described. The $n^{th}$ speech speed conversion factor $\alpha_n$ counting from the start of the input signal by unit time (5 ms) is basically $\alpha_n = \alpha a_n \times \alpha b_n \times \alpha c_n \times \alpha d_n \times \alpha e_n \times \alpha f_n$ when using equations (5), (6), (8), (9), (14), (15), (17), (18), (20), (21), (23), and (24) and $\alpha_n = \alpha a_n + \alpha b_n + \alpha c_n + \alpha d_n + \alpha e_n + \alpha f_n$ when using equations (7), (10), (16), (19), (22), and (25). However, in the case that the playback rate conversion factors a are provided, the factors are finely adjusted by the following steps. Any value, for example from 0.5 to 5.0, can be set as the playback rate conversion factor $\alpha$.

In the case that the playback rate conversion factor $\alpha$ is provided, then the length of the entire signal after conversion is expected to be $L/\alpha$, where the length of the entire input signal is L (in units of seconds). First, the speech speed conversion factor fine adjustment unit 140 performs speech speed conversion on all input signal intervals letting $\alpha f_n = \alpha a_n \times \alpha b_n \times \alpha c_n \times \alpha d_n \times \alpha e_n \times \alpha f_n$ when using equations (5), (6), (8), (9), (14), (15), (17), (18), (20), (21), (23), and (24) and performs speech speed conversion on all input signal intervals letting $\alpha f_n = \alpha a_n + \alpha b_n + \alpha c_n + \alpha d_n + \alpha e_n + \alpha f_n$ when using equations (7), (10), (16), (19), (22), and (25). As a result, the speech speed conversion factor fine adjustment unit 140 calculates the length $L_0$ of the entire converted voice after connection.

Next, using equation (26) below, the speech speed conversion factor fine adjustment unit 140 finely adjusts the speech speed conversion factors $\alpha f_n$ for each portion to determine the final speech speed conversion factor $\alpha_n$ and can thereby align the length of the entire converted signal with the required playback time length.

$$\alpha_n = \alpha f_n \times L_0/(L/\alpha) \tag{26}$$

If as frequently as possible the length is made to correspond to the same timing as when voice is converted uniformly at the playback rate conversion factor $\alpha$, then the speech speed conversion factor fine adjustment unit 140 can modify $\alpha_n$ by performing fine adjustment not with respect to the length L of the entire input signal, but rather the length of voice divided into shorter units. For example, when L is divisible into M intervals, i.e. $L=L_1+L_2+L_M$, the speech speed conversion factor fine adjustment unit 140 divides the input waveform into intervals $L_1, L_2, \ldots, L_M$, and in each divided interval, for the $m^{th}$ interval, first converts the speech speed of the $m^{th}$ interval using the speech speed conversion factor $\alpha af_n$ ($\alpha a_n \times \alpha b_n \times \alpha c_n \times \alpha d_n \times \alpha e_n \times \alpha f_n$ or $\alpha a_n+\alpha b_n+\alpha c_n+\alpha d_n+\alpha e_n+\alpha f_n$) of each portion per unit time (5 ms) for that interval and calculates the partial length $Lm_0$ of the converted voice after connection. The speech speed conversion factor fine adjustment unit 140 then calculates the speech speed conversion factors $\alpha_n$ by substituting Lm for L and $Lm_0$ for L of $L_0$ into equation (26) and performs speech speed conversion again in order to perform fine adjustment. Note that the speech speed conversion (waveform expansion/contraction) method for implementing the speech speed conversion factors $\alpha_n$ may be the same as in Embodiment 1.

Figure 10:
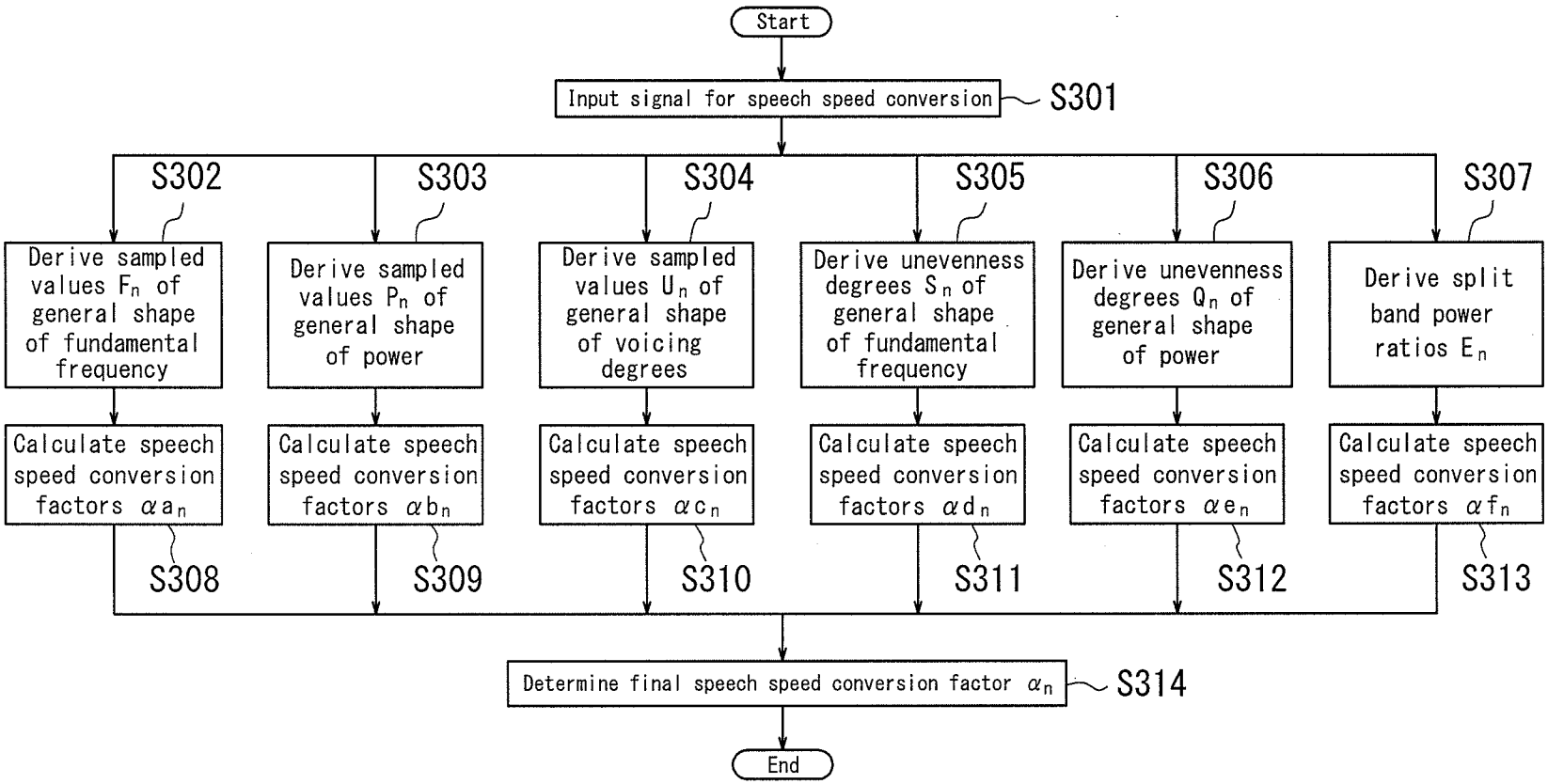
FIG. 10 is a flowchart illustrating operations of the speech speed conversion factor determining device according to Embodiment 3 of the present invention.

FIG. 10 is a flowchart illustrating operations of the speech speed conversion factor determining device 1*c* in Embodiment 3. A signal for speech speed conversion is input into the speech speed conversion factor determining device 1*c* (step S301). Upon input of a signal for speech speed conversion, the speech speed conversion factor determining device 1*c* uses the fundamental frequency general shape calculation unit 100 to derive the sampled values $F_n$ of the general shape of the fundamental frequency (step S302), uses the power general shape calculation unit 200 to derive the sampled values $P_n$ of the general shape of the power (step S303), uses the voicing degree general shape calculation unit 300 to derive the sampled values $U_n$ of the general shape of the voicing degrees (step S304), uses the fundamental frequency general shape calculation unit 400 and the unevenness degree calculation unit 410 to derive the unevenness degrees $S_n$ of the general shape of the fundamental frequency (step S305), uses the power general shape calculation unit 500 and the unevenness degree calculation unit 510 to derive the unevenness degrees $Q_n$ of the general shape of the power (step S306), and uses the frequency band splitting/power calculation unit 600 and the split band power ratio calculation unit 610 to derive the split band power ratios $E_n$ (step S307).

Upon derivation of the sampled values $F_n$ of the general shape of the fundamental frequency in step S302, the speech speed conversion factor determining device 1*c* uses the first speech speed conversion factor designation unit (speech speed conversion factor designation unit a) 120 to calculate the speech speed conversion factor $\alpha a_n$ (step S308). Upon derivation of the sampled values $P_n$ of the general shape of the power in step S303, the speech speed conversion factor determining device 1*c* uses the second speech speed conversion factor designation unit (speech speed conversion factor designation unit b) 220 to calculate the speech speed conversion factors $\alpha b_n$ (step S309). Upon derivation of the sampled values $U_n$ of the general shape of the voicing degrees in step S304, the speech speed conversion factor determining device 1*c* uses the third speech speed conversion factor designation unit (speech speed conversion factor designation unit c) 320 to calculate the speech speed conversion factors $\alpha c_n$ (step S310). Upon derivation of the unevenness degrees $S_n$ of the general shape of the fundamental frequency in step S305, the speech speed conversion factor determining device 1*c* uses the fourth speech speed conversion factor designation unit (speech speed conversion factor designation unit d) 420 to calculate the speech speed conversion factors $\alpha d_n$ (step S311). Upon derivation of the unevenness degrees $Q_n$ of the general shape of the power in step S306, the speech speed conversion factor determining device 1*c* uses the fifth speech speed conversion factor designation unit (speech speed conversion factor designation unit e) 520 to calculate the speech speed conversion factors $\alpha e_n$ (step S312). Upon derivation of the split band power ratios $E_n$ in step S307, the speech speed conversion factor determining device 1*c* uses the sixth speech speed conversion factor designation unit (speech speed conversion factor designation unit f) 620 to calculate the speech speed conversion factors $\alpha f_n$ (step S313). Finally, the speech speed conversion factor determining device 1*c* uses the speech speed conversion factor fine adjustment unit 140 to calculate the speech speed conversion factors $\alpha_n$ from the speech speed conversion factors $\alpha a_n$ through $\alpha f_n$. In the case that the playback rate conversion factor $\alpha$ is provided, $\alpha_n$ is finely adjusted to yield the final speech speed conversion factor (step S314).

Note that while an example has been described here of using all of the speech speed conversion factors $\alpha a_n$ through $\alpha f_n$, a structure may be adopted in which at least one of the speech speed conversion factors $\alpha c_n$ through $\alpha f_n$ is used.

Combined use of the sampled value $U_n$ of the general shape of the voicing degrees (speech speed conversion factors $\alpha c_n$) by the speech speed conversion factor determining device 1*c* offers the following advantages. As described above, this physical index can be calculated at every position in the input signal. Furthermore, this physical index can always be calculated even when background sound (music or noise) is present. Normally, the voicing degrees of vowels are high. On the other hand, the voicing degrees are low during complete silence and in a background sound such as music or noise, in which frequency components for a variety of sounds are generally intermingled. Accordingly, by lowering the speech speed at locations where the voicing degrees are high and raising the speech speed at locations where the voicing degrees are low, the speech speed is lowered during a vowel, which is an important portion of the voice, even when background sound is intermingled. Conversely, the speech speed is raised during complete silence and during portions with only background sound. Therefore, adding the voicing degrees as well as the sampled values $F_n$ of the general shape of the fundamental frequency allows for more stable and effective adaptive speech speed conversion for the entire input signal.

Furthermore, combined use of the unevenness degrees $S_n$ of the general shape of the fundamental frequency (speech speed conversion factor $s\alpha d_n$) by the speech speed conversion factor determining device 1*c* offers the following advantages. This approach differs from "lowering the speech speed where the fundamental frequency is high and raising the speech speed where it is low" as in Patent Literature 1. For example, in the case of two-person stand-up comedy by a man and a woman, the voices rapidly switch back and forth with nearly no pause in between. For such an input signal, the technique of "lowering the speech speed where the fundamental frequency is high and raising the speech speed where it is low" in Patent Literature 1 leads to the tendency of always lowering the speech speed for the woman since her voice is high and always slowing down for the man since his voice is low. As compared to the technique of Patent Literature 1 in which intervals with and without voice need to be distinguished correctly, the speech speed conversion factor determining devices 1*a* and 1*b* of Embodiments 1 and 2 have the advantage of operating stably by using the general shape of a continuous fundamental frequency that includes portions in which noise or background sound are intermingled, yet when male and female voices are intermingled, operations may become unstable since the speech speed conversion factors are set in proportion with the values of the general shape of the fundamental frequency.

In the general shape of the fundamental frequency, unevenness always occurs in both the female voice and the male voice due to factors such as the accent on words, and therefore by also using the unevenness degrees $S_n$ of the general shape of the fundamental frequency, the speech speed can be lowered at peaks and raised at valleys for both men and women, thus allowing for adaptive control of speech speed with a more equitable distribution for both men and women.

Furthermore, combined use of the unevenness degrees $Q_n$ of the general shape of the power (speech speed conversion factors $\alpha e_n$) by the speech speed conversion factor determining device 1*c* offers the following advantages. For example, in dramas or narrations, for dramatic effect a sentence spoken loudly is often followed by a sentence suddenly spoken in a soft voice. For such an input signal, the speech speed conversion factor determining device 1*b* of Embodiment 2 undeniably has a tendency to lower the relative speech speed for the sentence spoken loudly and to raise the relative speech speed for the sentence spoken softly.

Unevenness always occurs in places such as accent at the word level for both sentences spoken loudly and sentences spoken softly, and therefore by also using the unevenness degrees $Q_n$ of the general shape of the power, the speech speed can be lowered at peaks and raised at valleys for both sentences, thus allowing for adaptive control of speech speed with a more equitable distribution regardless of how loud a voice is.

Furthermore, combined use of the split band power ratios $E_n$ (speech speed conversion factors $\alpha f_n$) by the speech speed conversion factor determining device 1*c* offers the following advantages. Patent Literature 4 and 5 disclose distinguishing between a "voice interval" and a "silent interval" in an input signal by comparing a plurality of bands in the frequency spectrum in a normal state with the power of each corresponding band in the frequency spectrum of the input signal. The "power ratios between a lower band and a higher band when splitting a frequency spectrum into a plurality of bands" in the present invention, however, does not perform a comparison with the power of the spectrum in a normal state but rather targets only the frequency spectrum of the input signal at a particular instant, splits the frequency spectrum into bands, and calculates the power ratios between a lower band and a higher band among the split bands, thus representing a physical quantity of a completely different nature from the technique in Patent Literature 4 and 5. With the technique in Patent Literature 4 and 5, when distinguishing between a "voice interval" and a "silent interval", as described above it is difficult to distinguish between these intervals properly when background sound is intermingled, such as music at a certain volume, thus preventing adaptive speech speed conversion from being performed properly.

By also using the split band power ratios $E_n$, the speech speed is determined based on the power ratio between a lower band and a higher band among bands when targeting only the frequency spectrum of the input signal at a particular instant. Therefore, by definition erroneous judgment does not occur, thus allowing for stable control of speech speed. For example, control can be performed by lowering the speech speed when the power of the higher band is smaller than the power of the lower band and raising the speech speed when the power of the higher band is larger than the power of the lower band. Since the "power ratio between a lower band and a higher band" changes depending on the type of input signal, such as a voice interval, music, noise, silence, and the like, performing speech speed control based on this power ratio makes it possible to raise the speech speed in a voice interval and to lower the speech speed in intervals such as music, noise, and silence.

Like the speech speed conversion device 10*a* of Embodiment 1, a speech speed conversion device 10*c* of Embodiment 3 is provided with the above-described speech speed conversion factor determining device 1*c* and with the speech speed conversion unit 4, which performs speech speed conversion on an input signal in accordance with the speech speed conversion factors determined by the speech speed conversion factor determining device 1*c*. Operations when the speech speed conversion device 4 needs to operate in real time are similar to those of Embodiment 1.

Furthermore, as in Embodiment 1, a computer may be suitably used to function as the speech speed conversion factor determining device 1*c* or the speech speed conversion device 10*c*. Such a computer may be implemented by storing a program describing the processing that achieves the functions of the speech speed conversion factor determining device 1*c* in a storage unit of the computer and having the central processing unit (CPU) of the computer read and execute the program.

Furthermore, the program describing the processing can be recorded on a computer-readable storage medium such as a DVD or a CD-ROM, and the storage medium can be distributed by sale, transfer, loan, or the like. The program can also be distributed by being stored in a storage unit of a server on, for example, an IP network or other network and transferred over the network from the server to another computer.

For example, the computer that executes such a program can also temporarily store, in its own storage unit, the program recorded on a storage medium or transferred from the server. As another embodiment of this program, a computer may read a program directly from a storage medium and execute processing in accordance with the program. Furthermore, each time the program is transferred from a server to a computer, the computer may execute processing in accordance with the successively received program.

While the above embodiments have been described as representative examples, a variety of modifications and substitutions within the scope and spirit of the present invention will be apparent to a person of ordinary skill in the art. Accordingly, the present invention is not limited to the above embodiments but rather may be modified or altered in a variety of ways without deviating from the scope of the patent claims.

The present invention is useful for any situation requiring speech speed conversion. For example, the present invention allows for voice in television or radio to be listened to slowly in real time, or for content to be recorded on a hard disk recorder or the like and listened to slowly or quickly. Furthermore, there is demand on the part of the visually impaired for listening efficiently to audio data, and the present invention allows for recorded books and the like for the visually impaired to be listened to with high-speed playback. Moreover, in a language learning or voice training system, the present invention may be used when developing materials, or used during study to play back voice after converting the speech speed in accordance with the degree of learner improvement.

REFERENCE SIGNS LIST

1*a*, 1*b*, 1*c*: Speech speed conversion factor determining device

2: Physical index calculation unit

3: Speech speed conversion factor determining unit

4: Speech speed conversion unit
10*a*, 10*b*, 10*c*: Speech speed conversion device
100: Fundamental frequency general shape calculation unit
102: Sound/silence judgment unit
104: Fundamental frequency calculation unit
106: Smoothing unit
108: Pseudo fundamental frequency calculation unit
110: Fundamental frequency general shape connection unit
120: First speech speed conversion factor designation unit (speech speed conversion factor designation unit a)
140: Speech speed conversion factor fine adjustment unit
200: Power general shape calculation unit
202: Power calculation unit
204: Smoothing unit
220: Second speech speed conversion factor designation unit (speech speed conversion factor designation unit b)
300: Voicing degree general shape calculation unit
302: Voicing degree calculation unit
304: Smoothing unit
320: Third speech speed conversion factor designation unit (speech speed conversion factor designation unit c)
400: Fundamental frequency general shape calculation unit
410: Unevenness degree calculation unit
420: Fourth speech speed conversion factor designation unit (speech speed conversion factor designation unit d)
500: Power general shape calculation unit
510: Unevenness degree calculation unit
520: Fifth speech speed conversion factor designation unit (speech speed conversion factor designation unit e)
600: Frequency band splitting/power calculation unit
602: Spectrum calculation unit
604: Band splitting unit
606: Power calculation unit
610: Split band power ratio calculation unit
620: Sixth speech speed conversion factor designation unit (speech speed conversion factor designation unit f)

What is claimed is:

1. A speech speed conversion factor determining device for determining adaptive conversion factors for speech speed of an input signal, comprising:

a physical index calculation unit including:

a sound/silence judgment unit configured to distinguish between sound intervals and silent intervals of the input signal;

a fundamental frequency calculation unit configured to calculate a fundamental frequency of the input signal in the sound interval at given time intervals and to determine stable intervals in which change in values of the fundamental frequency is within a predetermined variation range and unstable intervals in which change in the values of the fundamental frequency exceeds the predetermined variation range;

a frequency smoothing unit configured to smooth a time variation of the fundamental frequency in the stable interval;

a pseudo fundamental frequency calculation unit configured to calculate, for the unstable interval and the silent interval, a pseudo fundamental frequency by interpolating a fundamental frequency with reference to values of the smoothed fundamental frequency in the stable interval; and a fundamental frequency general shape connection unit configured to connect the smoothed fundamental frequency and the pseudo fundamental frequency to obtain sampled values of a general shape of a continuous fundamental frequency;

the physical index calculation unit being configured to output the sampled values of the general shape of the fundamental frequency as a physical index; and a speech speed conversion factor designation unit configured to calculate speech speed conversion factors to be designated for the input signal based on the physical index.

2. The speech speed conversion factor determining device according to claim 1, wherein the physical index calculation unit includes a power calculation unit configured to calculate a power of the input signal at given time intervals and a power smoothing unit configured to smooth a time variation of the power to obtain sampled values of a general shape of the power, and the physical index calculation unit outputs the sampled values of the general shape of the fundamental frequency and the sampled values of the general shape of the power as the physical index.

3. The speech speed conversion factor determining device according to claim 2, wherein the physical index calculation unit includes a voicing degree calculation unit configured to calculate voicing degrees from an input signal waveform and a voicing degree smoothing unit configured to smooth a time variation of the voicing degrees to obtain sampled values of a general shape of the voicing degrees, and the physical index calculation unit outputs the sampled values of the general shape of the fundamental frequency, the sampled values of the general shape of the power, and the sampled values of the general shape of the voicing degrees as the physical index.

4. The speech speed conversion factor determining device according to claim 2, wherein the physical index calculation unit includes a fundamental frequency unevenness degree calculation unit configured to calculate unevenness degrees representing a trend of change in the general shape of the fundamental frequency, and the physical index calculation unit outputs the sampled values of the general shape of the fundamental frequency, the sampled values of the general shape of the power, and the unevenness degrees of the general shape of the fundamental frequency as the physical index.

5. The speech speed conversion factor determining device according to claim 2, wherein the physical index calculation unit includes a power unevenness degree calculation unit configured to calculate unevenness degrees representing a trend of change in the general shape of the power, and the physical index calculation unit outputs the sampled values of the general shape of the fundamental frequency, the sampled values of the general shape of the power, and the unevenness degrees of the general shape of the power as the physical index.

6. The speech speed conversion factor determining device according to claim 2, wherein the physical index calculation unit includes a frequency band splitting/power calculation unit configured to calculate a power spectrum of the input signal, a normalized power in a first frequency band, and a normalized power in a second frequency band higher than the first frequency band, and a split band power ratio calculation unit configured to calculate ratios between the normalized powers of the first frequency band and the second frequency band, and the physical index calculation unit outputs the sampled values of the general shape of the fundamental frequency, the sampled values of the general shape of the power, and the ratios between the normalized powers of the first frequency band and the second frequency band as the physical index.

7. The speech speed conversion factor determining device according to claim 2, wherein the speech speed conversion factor designation unit calculates the speech speed conversion factors based on the physical index and on a rate of contribution to the speech speed by each physical index.

8. The speech speed conversion factor determining device according to claim 7, further comprising a speech speed conversion factor fine adjustment unit configured to determine final speech speed conversion factors by, upon provision of a required playback time length of an entirety of the input signal or of divided portions of the input signal, finely adjusting the speech speed conversion factors so that a time length of the entirety of the input signal or of divided portions of the input signal matches the required playback time length.

9. A speech speed conversion device for performing adaptive speech speed conversion on an input signal, comprising:

the speech speed conversion factor determining device according to claim 8 and a speech speed conversion unit configured to perform speech speed conversion on the input signal in accordance with the speech speed conversion factors, wherein the speech speed conversion unit, upon provision of a required playback time length of an entirety of the input signal or of divided portions of the input signal, calculates an amount of temporal misalignment by comparing on a signal time series, at given time intervals, a target signal to be output when expanding or contracting the input signal by a uniform factor with a converted signal yielded by converting the input signal at the speech speed conversion factors, and the speech speed conversion factor fine adjustment unit readjusts subsequent speech speed conversion factors in accordance with the amount of temporal misalignment.

* * * * *